US009140142B2

(12) United States Patent
Shiotani et al.

(10) Patent No.: US 9,140,142 B2
(45) Date of Patent: Sep. 22, 2015

(54) MOUNTING/DISMOUNTING JIG FOR COMBUSTOR TAIL PIPE AND TAIL PIPE INSTALLATION METHOD

(75) Inventors: Shigetoshi Shiotani, Tokyo (JP); Kenichi Arase, Tokyo (JP); Naohiko Yoshida, Tokyo (JP); Shuji Mizokami, Tokyo (JP); Osamu Hasegawa, Tokyo (JP); Satoshi Tsuzuki, Hiroshima (JP); Hirohito Takeda, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 783 days.

(21) Appl. No.: 13/392,017

(22) PCT Filed: Apr. 30, 2010

(86) PCT No.: PCT/JP2010/003092

§ 371 (c)(1),
(2), (4) Date: Feb. 23, 2012

(87) PCT Pub. No.: WO2011/033697

PCT Pub. Date: Mar. 24, 2011

(65) Prior Publication Data

US 2012/0159955 A1 Jun. 28, 2012

(30) Foreign Application Priority Data

Sep. 16, 2009 (JP) ..... 2009-214815

(51) Int. Cl.
*F01D 25/28* (2006.01)
*F01D 9/02* (2006.01)

(52) U.S. Cl.
CPC ..... *F01D 25/285* (2013.01); *F01D 9/023* (2013.01); *F01D 25/28* (2013.01); *F05D 2230/60* (2013.01); *F05D 2230/70* (2013.01)

(58) Field of Classification Search
CPC combination set(s) only.
See application file for complete search history.

(56) References Cited

U.S. PATENT DOCUMENTS 5,911,680 A * 6/1999 Takeoka ..... 60/797

FOREIGN PATENT DOCUMENTS

| | | | |
|---|---|---|---|
| CN | 1159380 | A | 9/1997 |
| EP | 2051009 | A2 | 4/2009 |
| JP | 08-210642 | A | 8/1996 |
| JP | 09-079577 | A | 3/1997 |

(Continued)

OTHER PUBLICATIONS

Chinese Office Action dated Sep. 3, 2013, issued in corresponding Chinese Patent Application No. 201080040951.1 with English translation (10 pages).

(Continued)

*Primary Examiner* — Craig Kim
(74) *Attorney, Agent, or Firm* — Westerman, Hattori, Daniels & Adrian, LLP

(57) ABSTRACT

Provided is a tail cylinder attaching and detaching fixture that attaches and detaches a tail cylinder to and from a casing, the tail cylinder being included in a combustor inserted into the casing so that the front end is connected to an inlet portion of a combustion gas passageway, the tail cylinder attaching and detaching fixture including: a guide portion of which the front end is disposed inside the casing and the front end and the base end are respectively supported by the casing and which supports the tail cylinder so as to be movable in the axial direction of the combustor; and an advancing and retracting mechanism that advances and retracts the tail cylinder in the axial direction.

9 Claims, 24 Drawing Sheets

(56) References Cited

FOREIGN PATENT DOCUMENTS

| | | | |
|---|---|---|---|
| JP | 09-210361 | A | 8/1997 |
| JP | 10-196959 | A | 7/1998 |
| JP | 11-125426 | A | 5/1999 |
| JP | 3382746 | B2 | 3/2003 |
| JP | 3614976 | B2 | 1/2005 |

OTHER PUBLICATIONS

International Search Report for PCT/JP2010/003092, dated Jul. 20, 2010.
Written Opinion for PCT/JP2010/003092, dated Jul. 20, 2010.

* cited by examiner

MOUNTING/DISMOUNTING JIG FOR COMBUSTOR TAIL PIPE AND TAIL PIPE INSTALLATION METHOD

TECHNICAL FIELD

The present invention relates to a tail cylinder attaching and detaching fixture that attaches and detaches a tail cylinder of a combustor to and from a casing of a gas turbine and a tail cylinder attaching method.

Priority is claimed on Japanese Patent Application No. 2009-214815, filed Sep. 16, 2009, the content of which is incorporated herein by reference.

BACKGROUND ART

As shown in FIGS. 1 and 2, a gas turbine 200 generally includes a compressor 201 that produces compressed air, a plurality of combustors 1 that produces a combustion gas by mixing fuel with the compressed air produced in the compressor 201, and a turbine 202 that is driven by the combustion gas produced in the combustor 1. The combustor 1 includes an inner cylinder 2 to which compressed air and fuel are supplied to be burned and a tail cylinder 3 that introduces the combustion gas produced in the inner cylinder 2 into a combustion gas passageway 203 of the turbine 202. The plurality of combustors 1 are arranged in an annular shape so as to surround the turbine rotor, and are respectively connected to an inlet portion 203*a* of the combustion gas passageway 203 inside the turbine 202.

In each of the combustors 1, the tail cylinder 3 is inserted into the casing 4 so as to be connected to the inlet portion 203*a* of the combustion gas passageway 203, and the inner cylinder 2 is connected to the base end of the tail cylinder 3. As shown in FIGS. 2 and 3, an opening portion 4*a* of the casing 4 is blocked in a manner such that a cover body 7 is fixed to the cover fixing bolt hole 4*b* which is a cover fixing portion formed along the outer edge. Then, as shown in FIG. 1, a plurality of pipes 8 is arranged around the plurality of combustor 1 arranged in an annular shape, where the plurality of pipes include a fuel supply pipe that supplies fuel, a cooling air supply pipe that cools the combustor 1, and the like.

Here, the above-described combustor 1 is assembled by being inserted from the opening 4*a* into the casing 4 in order from the tail cylinder 3 and the inner cylinder 2 after the compressor 201, the casing 4, and the turbine 202 are constructed. Further, the respective components constituting the gas turbine 200 are worn in accordance with the activation thereof, are periodically inspected according to the individual cycles of the respective components, and replaced as necessary. Generally, since the inspection cycle of the combustor 1 is shorter than the inspection cycles of the turbine 202 and the compressor 201, there are many occasions where it is necessary to detach and inspect the combustor 1. The combustor 1 has a weight (for example, about 100 kg) such that the tail cylinder 3 or the inner cylinder 2 cannot be separately lifted by a person. Furthermore, it is difficult to ensure a foothold above an installation surface 200*a* of the gas turbine 200 in the vicinity of the casing 4. For this reason, in order to inspect the combustor 1, various devices which attach and detach the tail cylinder 3 to and from the casing 4 are proposed.

Specifically, there is proposed a device that includes an annular rail provided along the arrangement of combustors and a disassembling and assembling device provided on the rail (for example, see PTL 1). The disassembling and assembling device includes a hand portion that grips components of the combustors, an inserting and extracting portion that moves the hand portion forward and backward in the direction of the axis line of the combustor, and a circumferential traveling portion that makes a frame supporting the inserting and extracting portion travel along the rail. In the device of PTL 1, the positions of the frame, the inserting and extracting portion, and the hand portion are adjusted to a position corresponding to a desired combustor in a manner such that the circumferential traveling portion is made to travel along the rail. Then, the components of the combustors gripped by the hand portion may be inserted or extracted in a manner such that the hand portion is moved forward and backward by the inserting and extracting portion supported by the rail through the frame.

As another device, there is proposed a device that includes a column attached to a seat surface of a cylindrical seat of a casing of a gas turbine, a housing attached to the column, a screw bar rotatably attached to the housing, a holder attached to the lower side of the screw bar so that the inner cylinder is attached thereto, and a handle bar advancing and retracting the screw bar (for example, see PTL 2). In such a device, when the holder is attached to the inner cylinder so as to lift the screw bar, the inner cylinder is extracted from the tail cylinder.

PRIOR ART DOCUMENTS

Patent Document

[PTL 1] Japanese Patent Application Laid-Open No. 9-168931

[PTL 2] Japanese Patent Application Laid-Open No. 8-210642

SUMMARY OF INVENTION

Problem to be Solved by the Invention

However, in the device of PTL 1, there is a need to provide the rail along the arrangement of the combustors. Furthermore, in the case of attaching the tail cylinder, the hand portion and the tail cylinder gripped by the hand portion needs to be inserted into the casing from the rail while being supported in a cantilever shape in the frame and the inserting and extracting portion, and the lengths of the frame and the inserting and extracting portion needs to be shortened in order to ensure rigidity. For this reason, in the device of PTL 1, a problem arises in that the device increases in size overall. Further, various pipes surrounding the combustors need to be detached in order to install the device structure, which causes a problem in that the number of processes increases.

In the device of PTL 2, the structure such as a rail is not used, but the holder and the inner cylinder attached to the holder need to be supported in a cantilever shape by the column and the screw bar, and also the length of the member needs to be shortened. Further, when the tail cylinder is attached with such a device structure, the tail cylinder needs to be inserted into the deeper side of the casing, which causes a problem in that the length of the member is lengthened, hence the device increases in size.

The invention is made in view of the above-described circumstances, and it is an object of the invention to provide a tail cylinder attaching and detaching fixture and a tail cylinder attaching method that are used to attach and detach the tail cylinder to and from the inside of the casing even in a restricted working space with a simple structure.

Means for Solving the Problem

In order to solve the above-described problem, the invention proposes the following means.

According to the invention, there is provided a tail cylinder attaching and detaching fixture that attaches and detaches a tail cylinder to and from a casing, the tail cylinder being included in a combustor inserted into the casing so that the front end is connected to an inlet portion of a combustion gas passageway, the tail cylinder attaching and detaching fixture including: a guide portion of which the front end is disposed inside the casing and the front end and the base end are respectively supported by the casing and which supports the tail cylinder so as to be movable in the axial direction of the combustor; and an advancing and retracting mechanism that advances and retracts the tail cylinder in the axial direction.

According to this structure, since the front end and the base end of the guide portion are supported by the casing, it is possible to support the tail cylinder by the guide portion with the minimum length of the member ensured. Then, since the front end of the guide portion is disposed inside the casing, it is possible to insert the tail cylinder into the casing in the axial direction of the combustor. Further, since the advancing and retracting mechanism advancing and retracting the tail cylinder in the axial direction of the combustor is formed separately from the guide portion supporting the tail cylinder so as to be movable in the axial direction of the combustor, it is possible to obtain a compact and simple structure overall without increasing the size of the advancing and retracting mechanism. For this reason, the guide portion and the advancing and retracting mechanism may be installed even in a restricted space, so that the tail cylinder may be inserted into the casing so as to be attached thereto or the tail cylinder may be detached from the casing so as to be extracted therefrom.

A support pin may be further provided in the front end of the guide portion so as to be fitted to a concave portion provided inside the casing, wherein the front end of the guide portion may be supported in a manner such that the support pin is fitted to the concave portion.

In this case, since the support pin of the front end of the guide portion inserted into the casing is only inserted and fitted to the concave portion in order to support the front end of the guide portion, it is possible to easily attach the front end of the guide portion even inside the narrow casing.

A base end fixing portion may be further provided so as to be fixed to the outer surface of the casing, wherein the base end of the guide portion may protrude from an opening portion of the casing toward the outside of the casing and may be supported by the base end fixing portion.

In this case, since the base end of the guide portion protrudes from the opening portion of the casing to the outside of the casing while being supported by the outer surface of the casing by the base end fixing portion, it is possible more stably move the tail cylinder between the outside and the inside of the casing.

The guide portion may include a front end member that is disposed inside the casing and a base end member that is attachably and detachably connected to the front end member and is disposed outside the casing.

In this case, since the guide portion includes at least two attachable and detachable members, the front end member and the base end member, it is possible to shorten the length of each member, reduce the weight thereof, and more easily perform the attachment in a narrow space. Further, after the front end member is attached to the inside of the casing, the base end member may be connected to the front end member while it is attached to the tail cylinder in advance.

The base end fixing portion may include: an attachment member that is provided along the outer edge of the opening portion and is attached to a cover body fixing portion fixing a cover body blocking the opening portion, and a support member that protrudes from the attachment member and supports the base end of the guide portion.

In this case, since the base end fixing portion is attached to the cover body fixing portion fixing the cover body using the attachment member and the base end of the guide portion is supported by the support member, it is possible to obtain the simpler structure without providing new means for fixing the base end fixing portion to the outer surface of the casing.

A moving portion may be further provided so as to be attachably and detachably provided in the tail cylinder and be guided by the guide portion in the axial direction.

In this case, the moving portion guided by the guide portion in the axial direction of the combustor is attachably and detachably provided in the tail cylinder. For this reason, at the time of attaching the tail cylinder to the inside of the casing, it is possible to move the tail cylinder by the moving portion and detach the tail cylinder from the moving portion after the movement. Further, even at the time of detaching the tail cylinder from the inside of the casing, it is possible to attach the tail cylinder through the attachment between the moving portion and the tail cylinder by moving the moving portion after the installation of the guide portion and easily attach and detach the tail cylinder.

The support pin may be attached so that the position is adjustable about the axis line of the guide portion.

In this case, when the position of the support pin is adjusted about the axis line with respect to the guide portion, the relative position between the guide portion and the casing may be adjusted while the support pin is fitted to the concave portion so that the guide portion is attached to the casing. For this reason, it is possible to accurately and more easily connect the tail cylinder supported by the guide portion using the inlet portion of the combustion gas passageway inside the casing.

Further, according to the invention, there is provided a tail cylinder attaching method of inserting a tail cylinder of a combustor into a casing so that the front end is connected to an inlet portion of a combustion gas passageway, the tail cylinder attaching method including: inserting a guide portion, which moves the tail cylinder in the axial direction of the combustor, from the front end of the guide portion into the casing; fixing the front end and the base end of the guide portion into the casing in the axial direction of the combustor; attaching the tail cylinder to the guide portion; moving the tail cylinder toward the front end along the guide portion; and connecting the tail cylinder to the inlet portion of the combustion gas passageway.

According to this method, the front end and the base end may be supported by the casing so as to follow the axial direction of the combustor in a manner such that the guide portion is inserted into the casing from the front end thereof. At this time, since the front end and the base end of the guide portion are supported by the casing, it is possible to support the tail cylinder by the guide portion with the minimum length of the member. Further, the guide portion is attached to the tail cylinder and the tail cylinder is moved toward the front end along the guide portion having a front end inserted into the casing so as to be connected to the inlet portion of the combustion gas passageway. Then, as described above, since the guide portion may be set to have the minimum length of the member, it is possible to attach the tail cylinder in a restricted space.

The guide portion may include a front end member that is disposed inside the casing and a base end member that is connected to the front end member and is disposed outside the casing. When the guide portion is inserted into the casing, the front end member may be inserted into the casing so that the front end and the base end of the front end member are supported by the casing, the front end of the base end member may be connected to the base end of the front end member supported by the casing, and then the base end of the base end member may be supported by an outer surface of the casing.

In this case, after the front end and the base end of the front end member are supported by the casing, the front end of the base end member is connected to the base end of the front end member supported by the casing, and the base end of the base end member is supported by the outer surface of the casing, so that the whole guide portion is supported by the casing. Here, as described above, since the guide portion includes two members, the front end member and the base end member, it is possible to shorten the length of the member for each member, reduce the weight thereof, and more easily perform the work even in a narrow space. Further, since the base end member on the side of the base end of the guide portion protrudes from the opening portion of the casing toward the outside of the casing, it is possible to stably move the tail cylinder between the outside and the inside of the casing.

Before the front end of the base end member is connected to the base end of the front end member, the tail cylinder may be attached to the base end member, and the front end of the base end member attached with the tail cylinder may be connected to the base end of the front end member.

In this case, since the tail cylinder is attached to the base end member which is not connected yet to the front end member, it is possible to perform the attachment work of the heavy tail cylinder in a location with good working conditions.

Effect of the Invention

According to the tail cylinder attaching and detaching fixture of the invention, it is possible to attach and detach the tail cylinder to and from the inside of the casing even in a restricted space with a simple structure.

Further, according to the tail cylinder attaching method of the invention, it is possible to perform the attachment work with a simple device structure and attach the tail cylinder to the inside of the casing in a restricted working space.

MODE FOR CARRYING OUT THE INVENTION

First Embodiment

Figure 1:
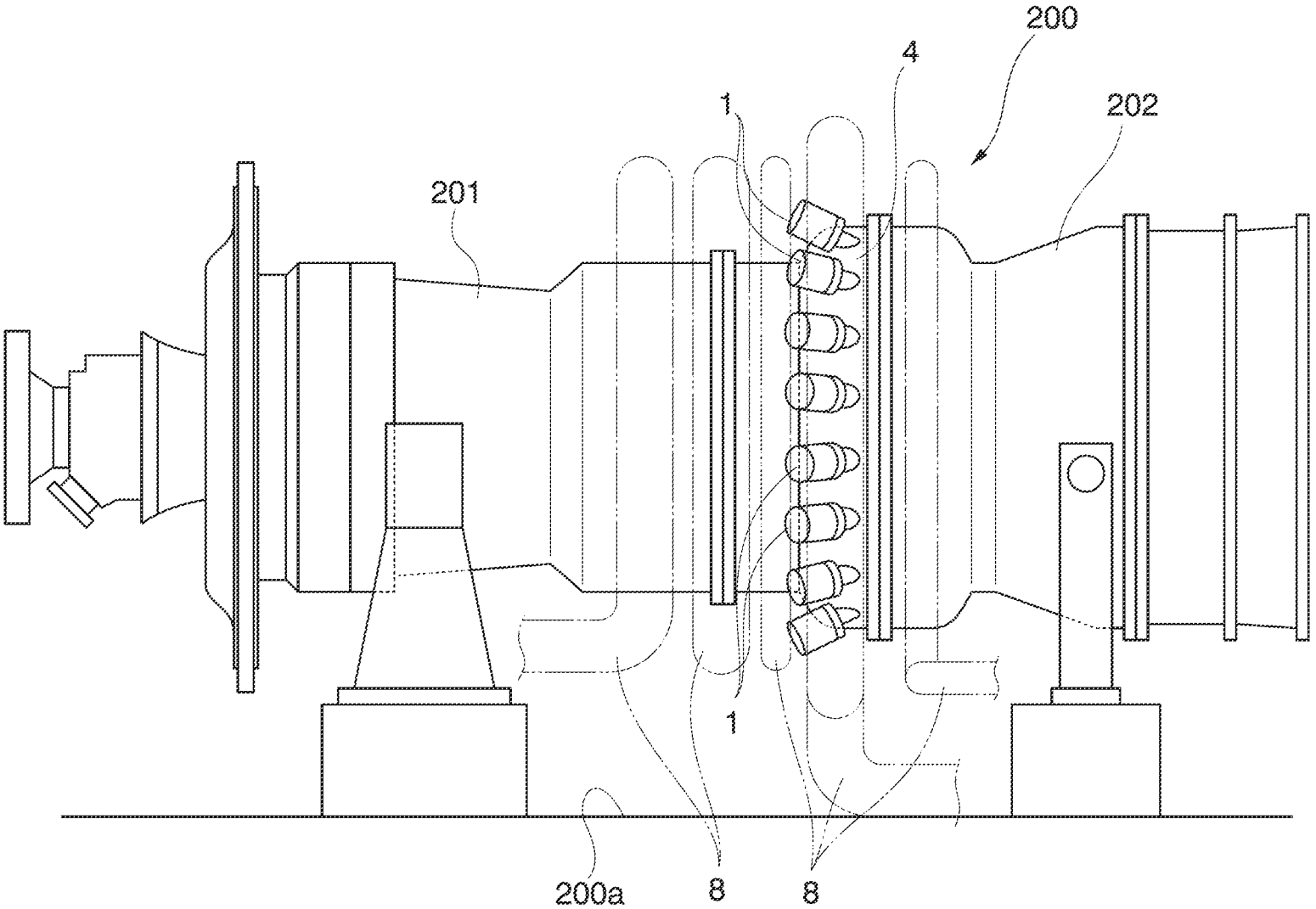
FIG. 1 is a side view showing the outline of a gas turbine.
Figure 2:
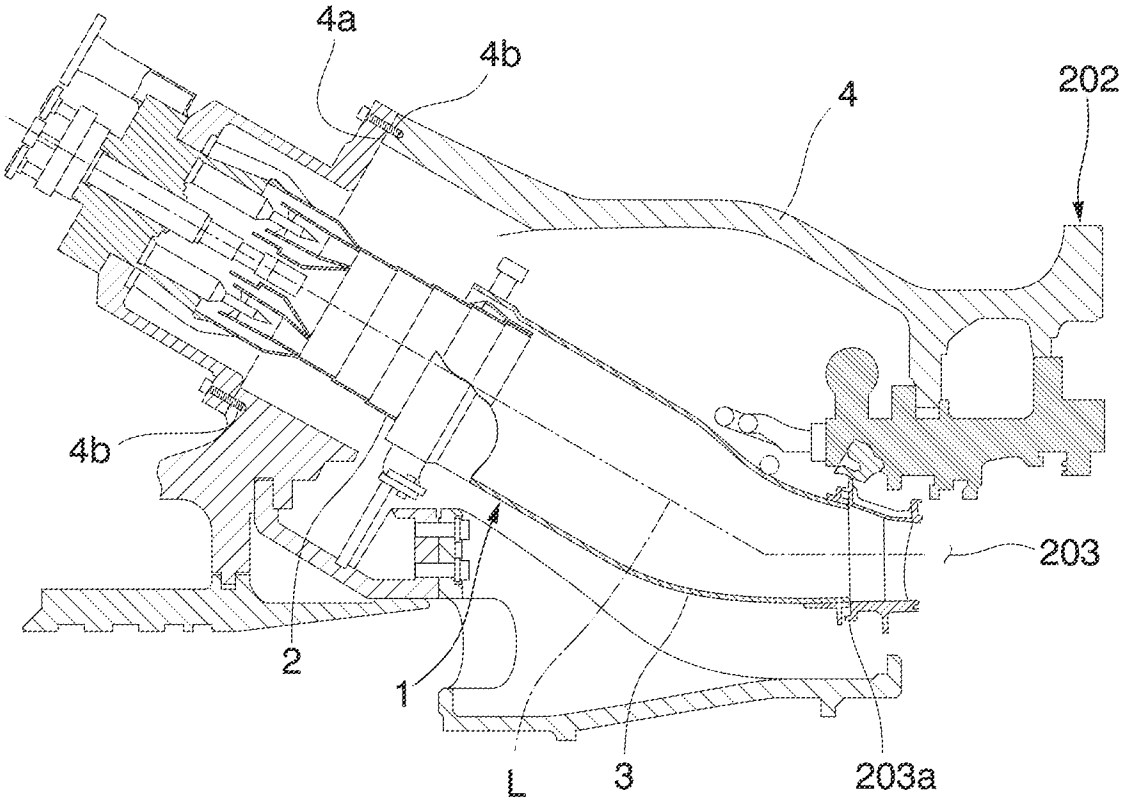
FIG. 2 is a cross-sectional view showing the detail of a combustor and a casing of the gas turbine.
Figure 3:
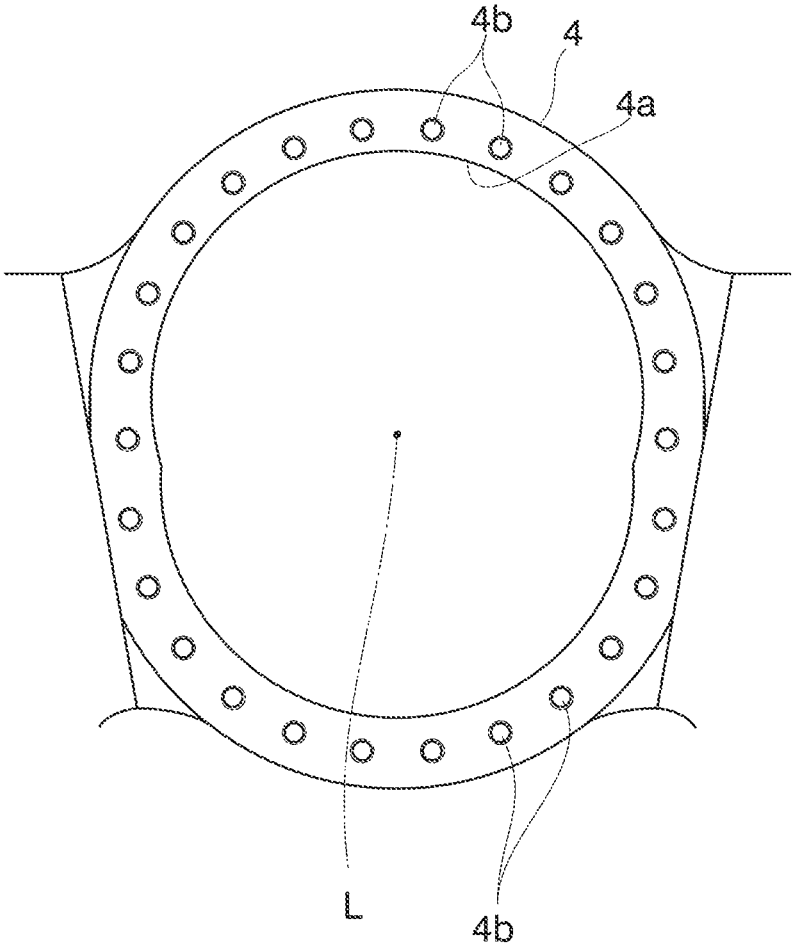
FIG. 3 is a front view showing the detail of an opening portion of the casing of the gas turbine.

Hereinafter, a first embodiment according to the invention will be described by referring to the drawings.

Furthermore, in a gas turbine 200, a combustor 1 and the attachment structure of the combustor 1 and a casing 4 are basically the same as those of the related art. For this reason, only differing features will be described.

Figure 4:
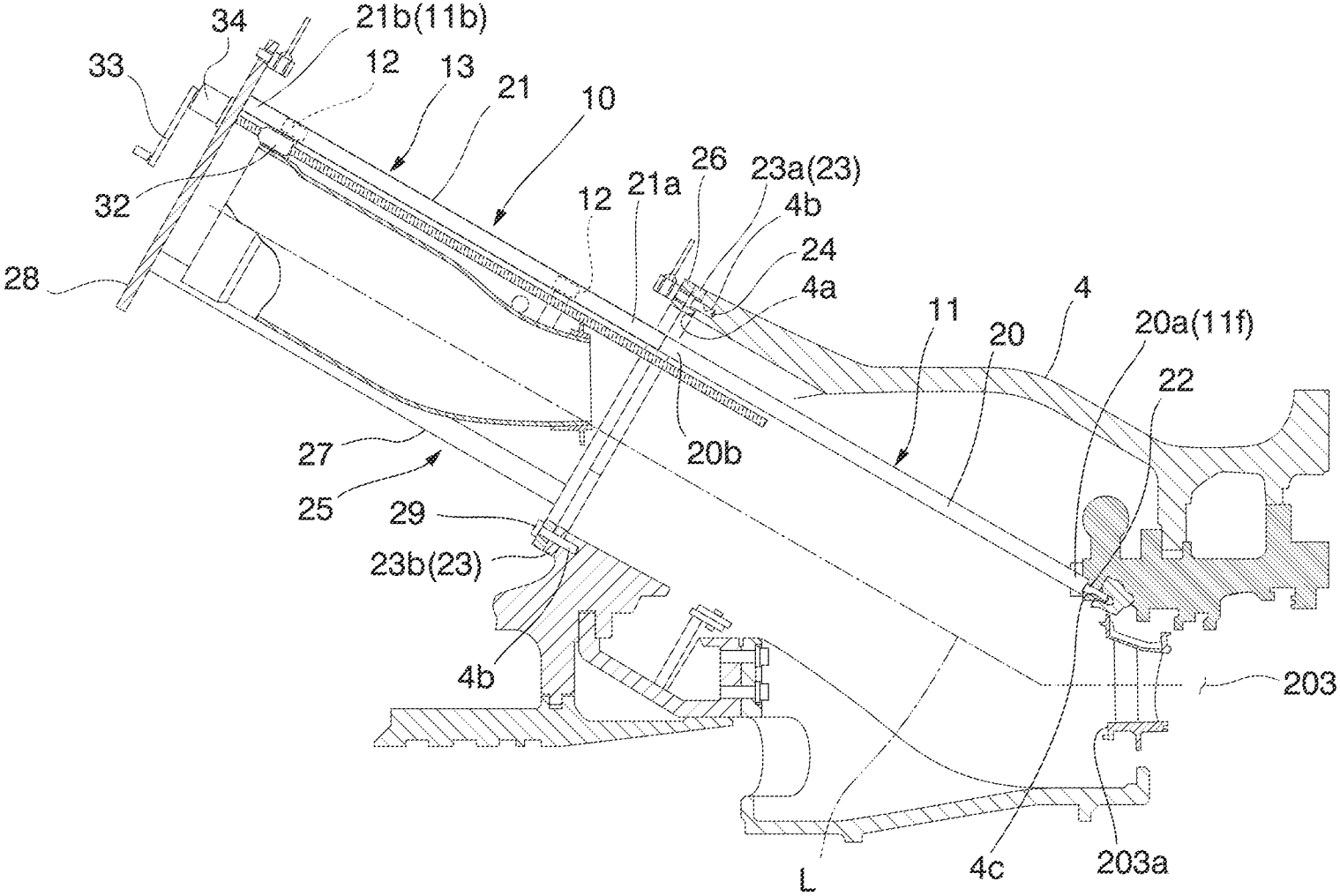
FIG. 4 is a cross-sectional view showing a state where an attaching and detaching fixture of a first embodiment of the invention is attached to a casing.

FIG. 4 shows a state where an attaching and detaching fixture 10 of a tail cylinder 3 of the embodiment is attached to a casing 4. As shown in FIG. 4, the attaching and detaching fixture 10 includes a guide portion 11 that is disposed along the direction of the axis line L of the combustor 1, a moving portion 12 that is attachable to and detachable from the tail cylinder 3 and is movable along the guide portion 11, and an advancing and retracting mechanism 13 that advances and retracts the tail cylinder 3 attached to the guide portion 11 through the moving portion 12 along the direction of the axis line L of the combustor 1.

Figure 5:
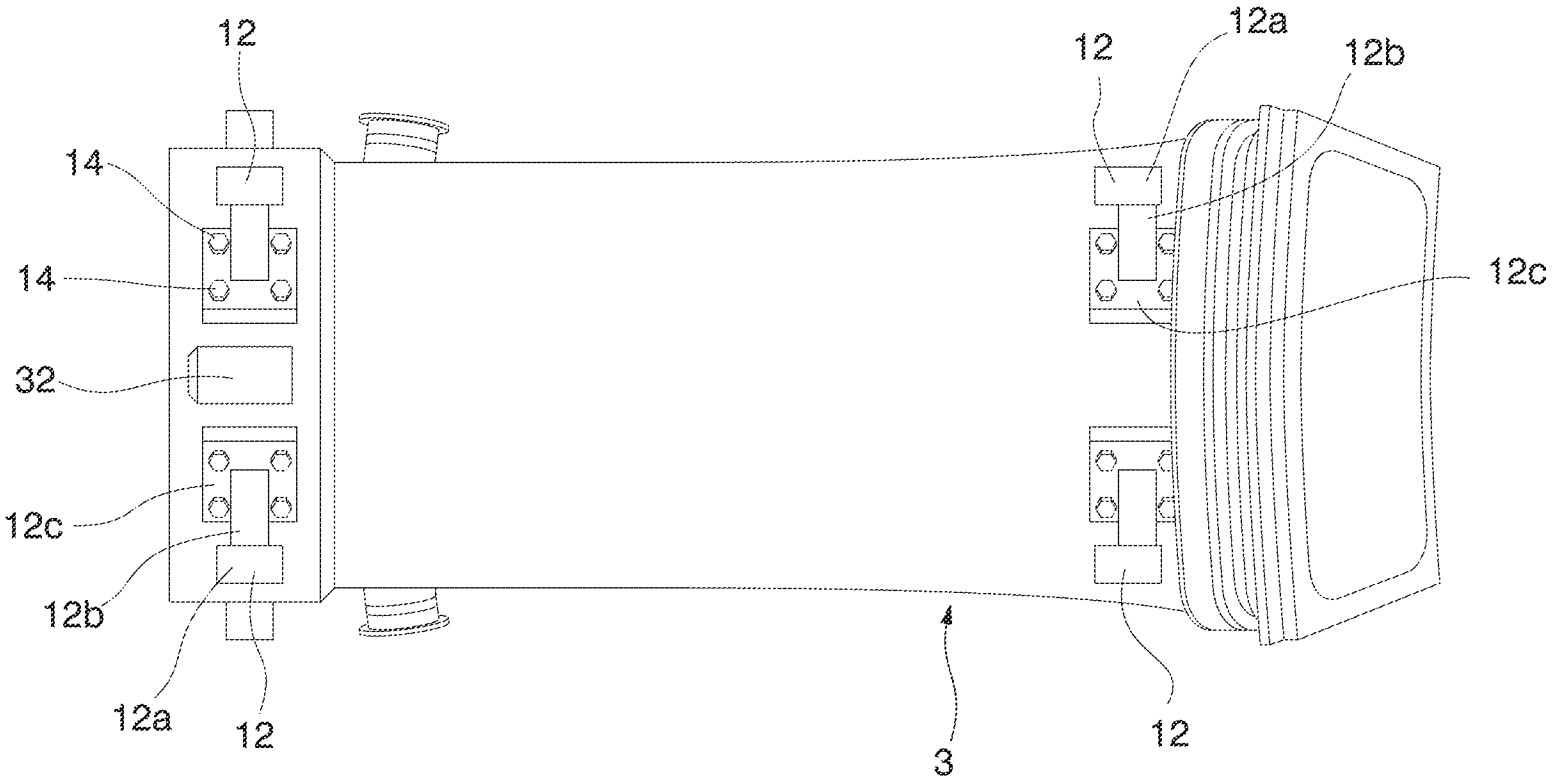
FIG. 5 is a plan view showing a state where a moving portion is attached to a tail cylinder in the attaching and detaching fixture of the first embodiment of the invention.
Figure 6:
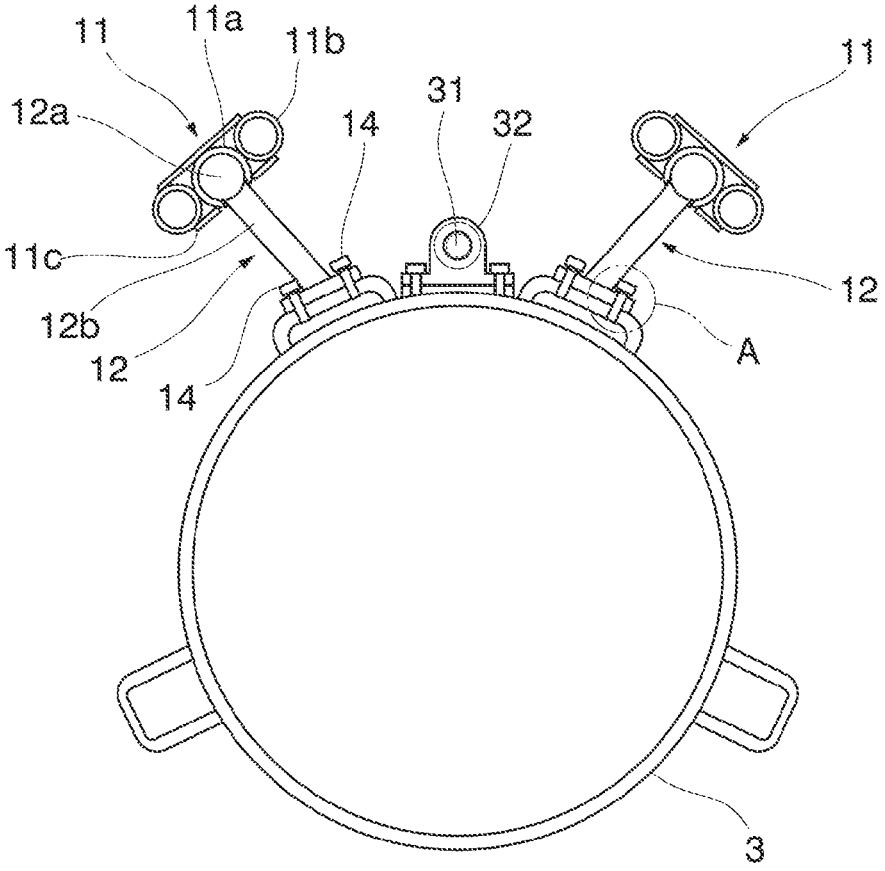
FIG. 6 is a front view showing a state where the moving portion is attached to the tail cylinder in the attaching and detaching fixture of the first embodiment of the invention.
Figure 7:
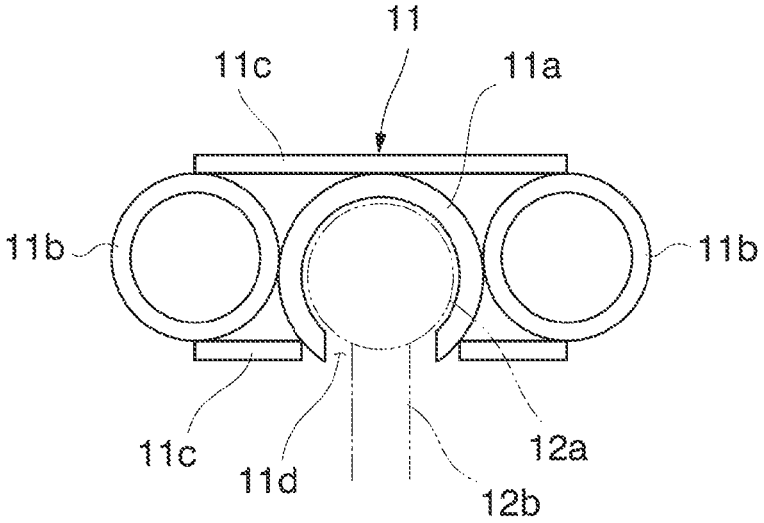
FIG. 7 is a cross-sectional view of a guide portion in the attaching and detaching fixture of the first embodiment of the invention.

As shown in FIGS. 5 and 6, in the embodiment, the guide portion 11 is provided as a pair of guide portions that are symmetrical to each other about the axis line L of the combustor 1 while being attached to the casing 4. As shown in FIG. 7, the guide portion 11 includes a guide body 11*a* that has a substantially C-shaped cross-section, a pair of reinforcing members 11*b* that is formed in a substantially cylindrical shape and interposes the guide body 11*a*, and a connection member 11*c* that connects the reinforcing members 11*b* and the guide body 11*a* to each other.

On the other hand, as shown in FIGS. 5 and 6, four moving portions 12 are provided, and are provided at the front end side and the base end side of the tail cylinder 3 so as to respectively correspond to the pair of guide portions 11. Each of the moving portions 12 includes a moving body 12*a* that is inserted into the guide body 11*a*, an arm portion 12*b* that extends from the moving body 12*a*, and a fixing portion 12*c* that is provided at the front end of the arm portion 12*b* and is fixed to the tail cylinder 3. The width of the arm portion 12*b* is set to be smaller than a gap 11*d* of the guide body 11*a*, and the arm portion is disposed at the gap 11*d* of the guide body 11*a* while the moving body 12*a* is inserted into the guide body 11*a*.

Figure 8:
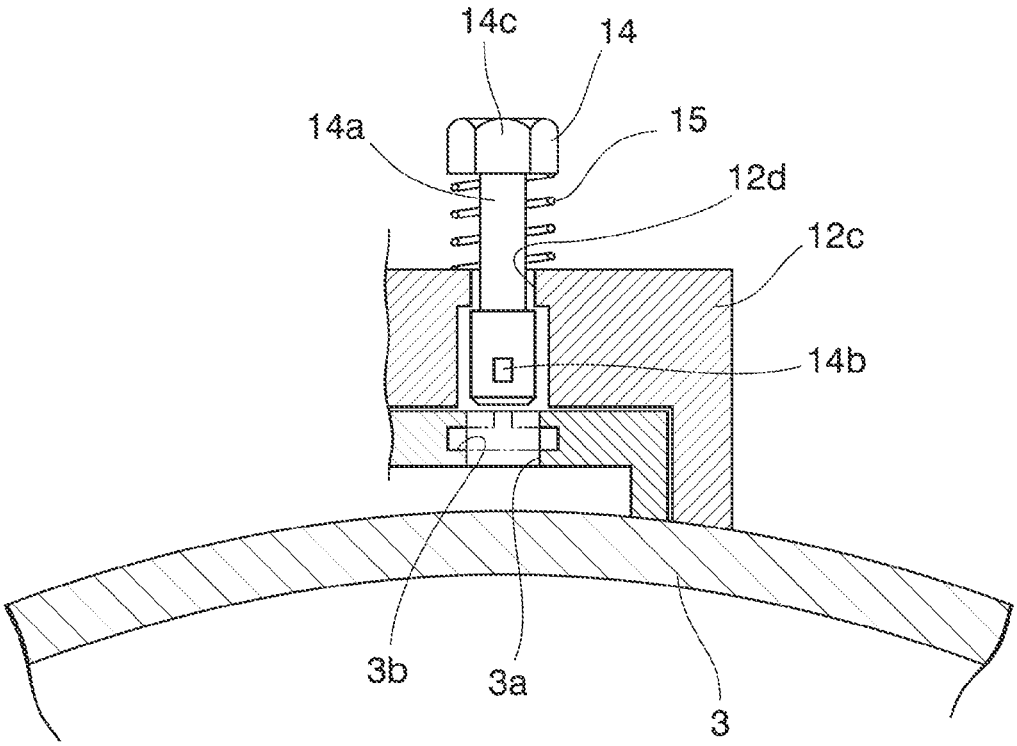
FIG. 8 is a cross-sectional view showing the fixing structure of the moving portion and the tail cylinder in the attaching and detaching fixture of the first embodiment of the invention and showing a fixing release state.
Figure 9:
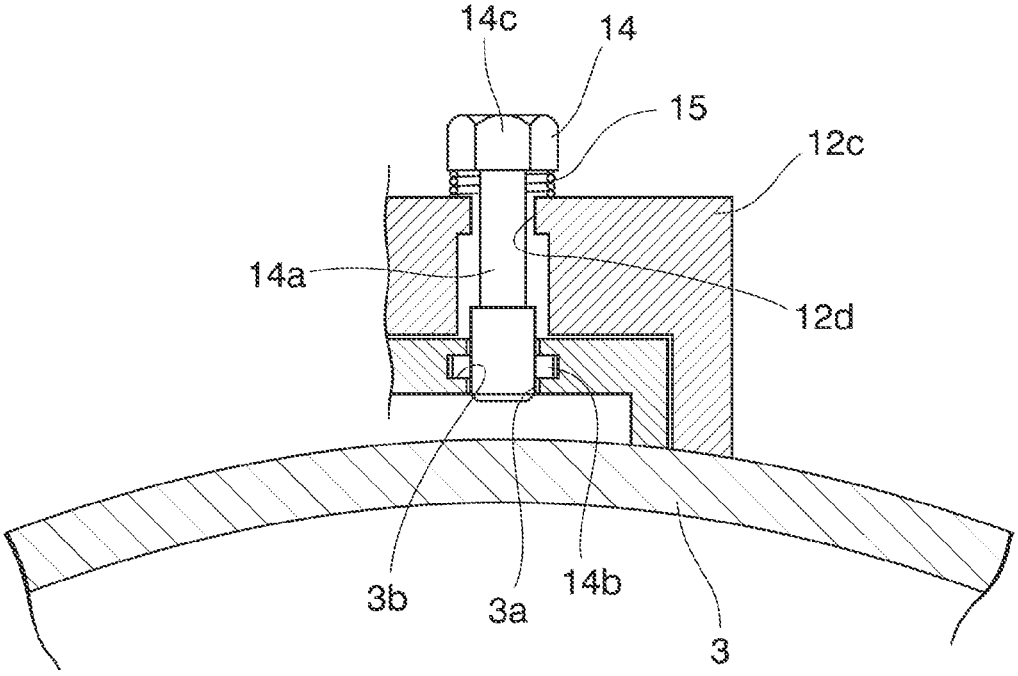
FIG. 9 is a cross-sectional view showing the fixing structure of the moving portion and the tail cylinder in the attaching and detaching fixture of the first embodiment of the invention.

As shown in FIGS. 8 and 9, the fixing portion 12*c* is provided with a fixture inserting hole 12*d* through which the fixture 14 is inserted. The fixture 14 includes a shaft portion 14*a* that is inserted through the fixture inserting hole 12*d*, a key 14*b* that is provided at the front end of the shaft portion 14*a* near the tail cylinder 3, and a head portion 14*c* that is provided at the base end of the shaft portion 14*a* so as to increase in diameter. A spring member 15 is interposed between the head portion 14*c* and the fixing portion 12*c*. On the other hand, the tail cylinder 3 is provided with an insertion hole 3*a* through which the front end of the shaft portion 14*a* of the fixture 14 is insertable and a key groove 3*b* which is formed in the outer peripheral surface of the insertion hole 3*a* and into which the key 14*b* is inserted. The key groove 3*b* is formed in the axial direction of the insertion hole 3*a* and then is formed in the circumferential direction. For this reason, when the fixture 14 is made to advance toward the tail cylinder 3 against the biasing action of the spring member 15 so that the front end of the shaft portion 14*a* is inserted into the insertion hole 3*a* and the fixture 14 is rotated about the axis in this state, the key 14*b* and the key groove 3*b* engage with each other, so that the tail cylinder 3 may be fixed to the moving portion 12. Further, when the fixture 14 is rotated about the axis in the direction opposite to the fixing direction in a fixed state so as to release the engagement between the key 14*b* and the key groove 3*b*, the moving portion 12 may be detached from the tail cylinder 3.

Figure 10:
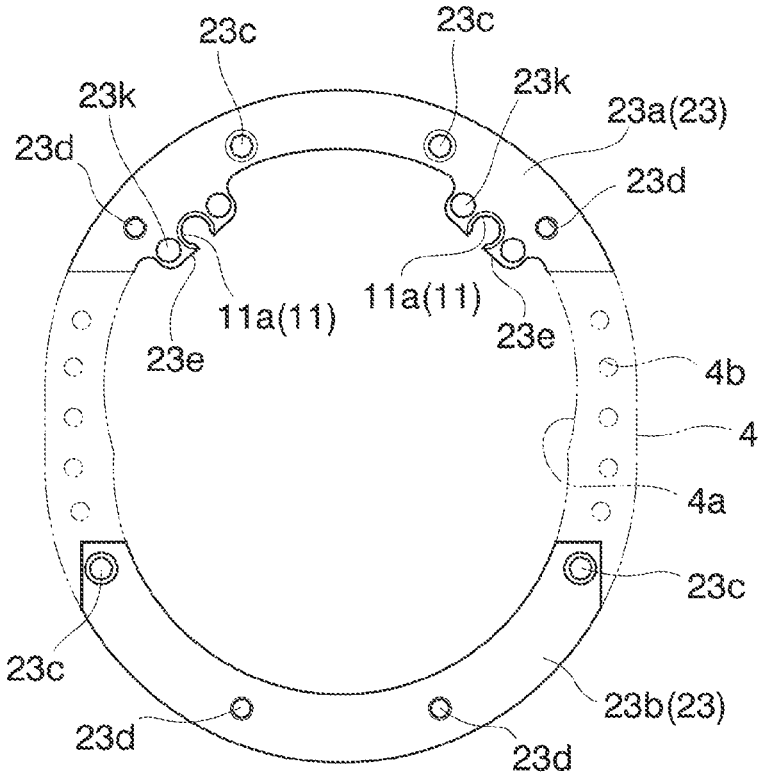
FIG. 10 is a cross-sectional view showing the detail of a front end member of a guide portion and a first casing attaching plate in the attaching and detaching fixture of the first embodiment of the invention.

Here, as shown in FIG. 4, in the embodiment, the guide portion 11 moving the moving portion 12 includes a front end member 20 that forms the front end and a base end member 21 that forms the base end while being attached to the front end member 20 in an attachable and detachable manner, and each of the front end member 20 and the base end member 21 includes the guide body 11*a*, the reinforcing member 11*b*, and the connection member 11*c*. As shown in FIGS. 4 and 10, the front end 20*a* of the front end member 20 is provided with a support pin 22 that protrudes therefrom. On the other hand, the inner surface of the casing 4 is provided with a concave portion 4*c* to which the support pin 22 is fitted, and a front end 11*f* of the guide portion 11 is supported by the casing 4 in a manner such that the support pin 22 provided in the front end member 20 is fitted to the concave portion 4*c*.

Figure 11:
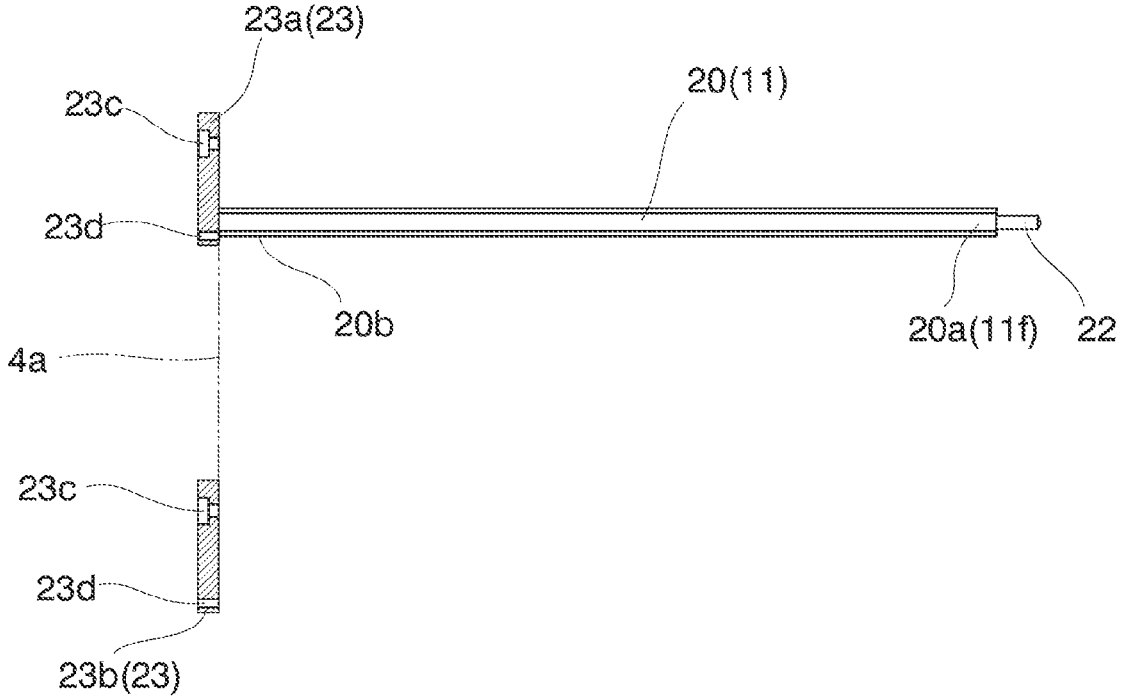
FIG. 11 is a front view showing the detail of the front end member of the guide portion and the first casing attaching plate in the attaching and detaching fixture of the first embodiment of the invention.

Further, the length of the front end member 20 is set to match the depth of the casing 4, and a first casing attaching plate 23 is attachably and detachably mounted on the base end 20*b* positioned near the opening portion 4*a*. As shown in FIGS. 10 and 11, the first casing attaching plate 23 is formed in a substantially annular shape along the outer edge of the opening portion 4*a* of the casing 4, and in the embodiment, includes an upper member 23*a* to which the guide portion 11 is connected and which is formed in a substantially circular-arc shape and a lower member 23*b* that is attached to the casing 4 at the side facing the upper member 23*a* with the axis line L of the combustor 1 interposed therebetween and is formed in a substantially circular-arc shape.

The upper member 23*a* and the lower member 23*b* constituting the first casing attaching plate 23 are respectively provided with a first penetration hole 23*c* and a second penetration hole 23*d* which correspond to a cover fixing bolt hole 4*b* serving as a cover fixing portion of a cover body 7 covering the opening portion 4*a*. The first penetration hole 23*c* is used to fix each of the upper member 23*a* and the lower member

23*b* of the first casing attaching plate 23, and includes a hole body through which a shaft portion of a fixing bolt 24 (see FIG. 4) threaded into the cover fixing bolt hole 4*b* and an accommodation concave portion which increases in diameter from the hole body at the opposite side of the surface coming into contact with the casing 4 of the upper member 23*a* and accommodates the head portion of the fixing bolt 24. Further, as described below, the second penetration hole 23*d* is used to fix the base end fixing portion 25, and is provided with only the hole body through which the shaft portion of the fixing bolt 29 threaded into the cover fixing bolt hole 4*b* is inserted. Further, each of the upper member 23*a* and the lower member 23*b* is provided with two first penetration holes 23*c* and two second penetration holes 23*d*, so that four penetration holes are provided in total for each member. In the upper member 23*a*, the first penetration holes 23*c* are disposed so as to be closer to the center, and the second penetration holes 23*d* are respectively disposed at the outside of the first penetration holes 23*c*. In contrast, in the lower member 23*b*, the second penetration holes 23*d* are disposed so as to be closer to the center, and the first penetration holes 23*c* are respectively disposed at the outside of the second penetration holes 23*d*. In the upper member 23*a* and the lower member 23*b*, the arrangement relationship of the first penetration holes 23*c* and the second penetration holes 23*d* is reversed.

Figure 12:
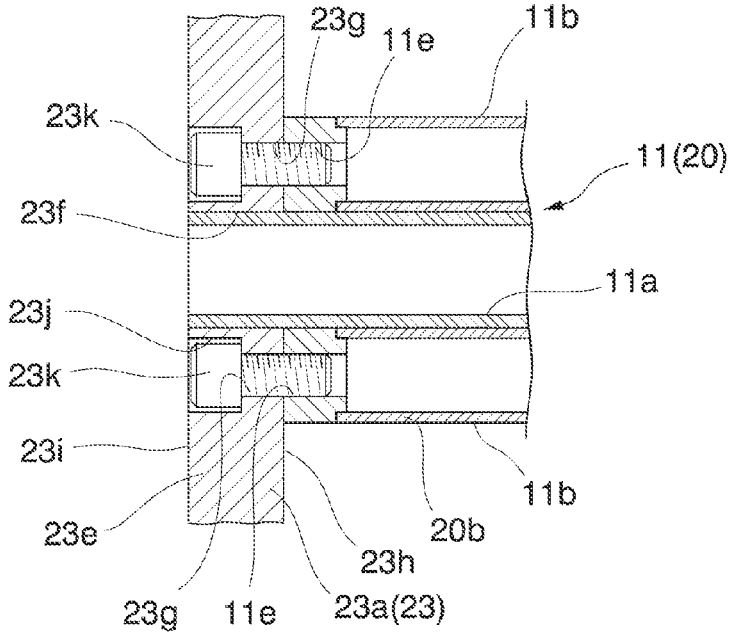
FIG. 12 is a cross-sectional view showing the detail of the fixing structure of the front end member of the guide portion and the first casing attaching plate in the attaching and detaching fixture of the first embodiment of the invention.

Further, the inner edge of the upper member 23*a* is provided with connection portions 23*e* that are provided at positions corresponding to the guide portions 11 so as to protrude toward the inner periphery and connect the front end member 20 in an attachable and detachable manner. As shown in FIG. 12, the connection portion 23*e* is provided with a guide inserting hole 23*f* into which the guide body 11*a* of the front end member 20 is inserted and a bolt inserting hole 23*g* which is formed at both sides of the guide inserting hole 23*f*. On the other hand, in the base end 20*b* of the front end member 20 of the guide portion 11, the guide body 11*a* protrudes by the amount corresponding to the thickness of the first casing attaching plate 23 with respect to the reinforcing member 11*b*. For this reason, when the guide body 11*a* is inserted into the guide inserting hole 23*f* so that the reinforcing member 11*b* comes into contact with the first casing attaching plate 23, the end of the guide body 11*a* is positioned at substantially the same level as that of the other surface 23*i* opposite to one surface 23*h* with which the reinforcing member 11*b* of the first casing attaching plate 23 comes into contact. Further, the end of the reinforcing member 11*b* is provided with a connection bolt hole 11*e* that corresponds to the bolt inserting hole 23*g*. For this reason, when a connection bolt 23*k* inserted through the bolt inserting hole 23*g* from the other surface 23*i* is threaded into the connection bolt hole 11*e*, the upper member 23*a* of the first casing attaching plate 23 is connected to the front end member 20 of the guide portion 11. Here, the bolt inserting hole 23*g* is provided with an accommodation concave portion 23*j* that accommodates the head portion of the connection bolt 23*k*, so that the connection bolt 23*k* does not protrude toward the other surface 23*i*.

Figure 13:
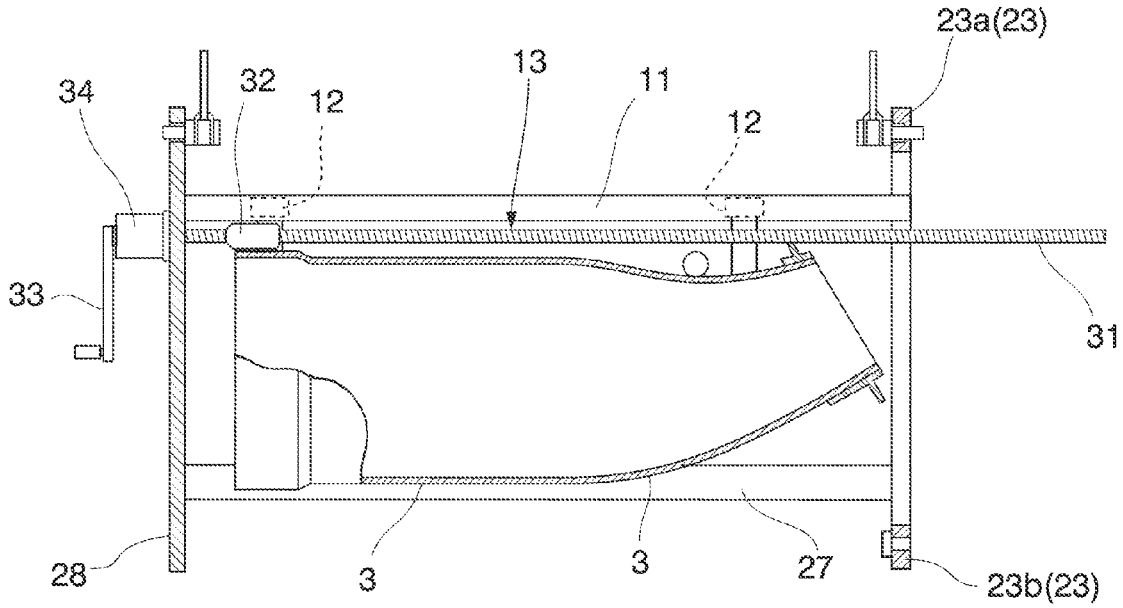
FIG. 13 is a cross-sectional view showing the detail of the base end member of the guide portion, the base end fixing portion, and the advancing and retracting mechanism in the attaching and detaching fixture of the first embodiment of the invention.
Figure 14:
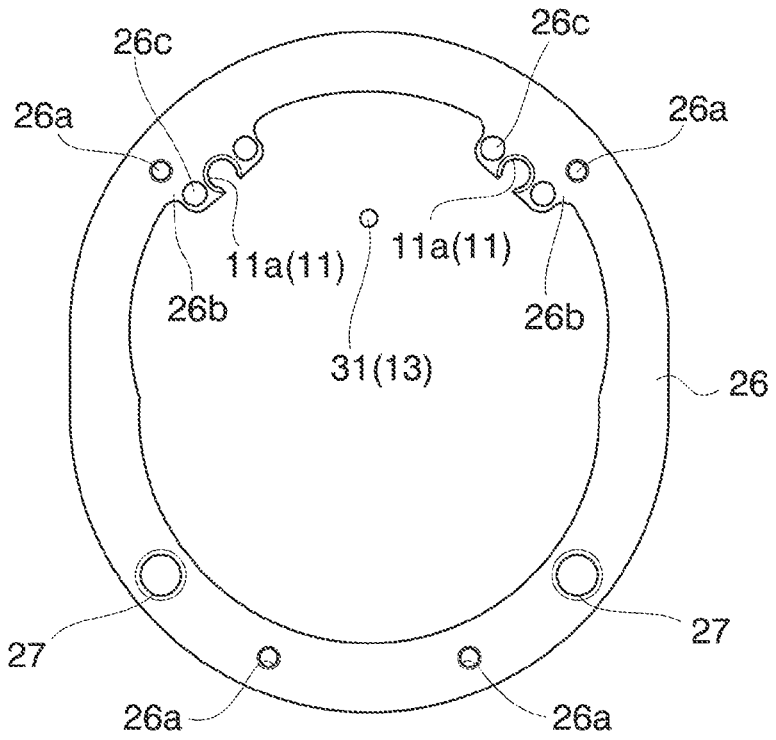
FIG. 14 is a rear elevation view showing the detail of the base end member of the guide portion, the base end fixing portion, and the advancing and retracting mechanism in the attaching and detaching fixture of the first embodiment of the invention.
Figure 15:
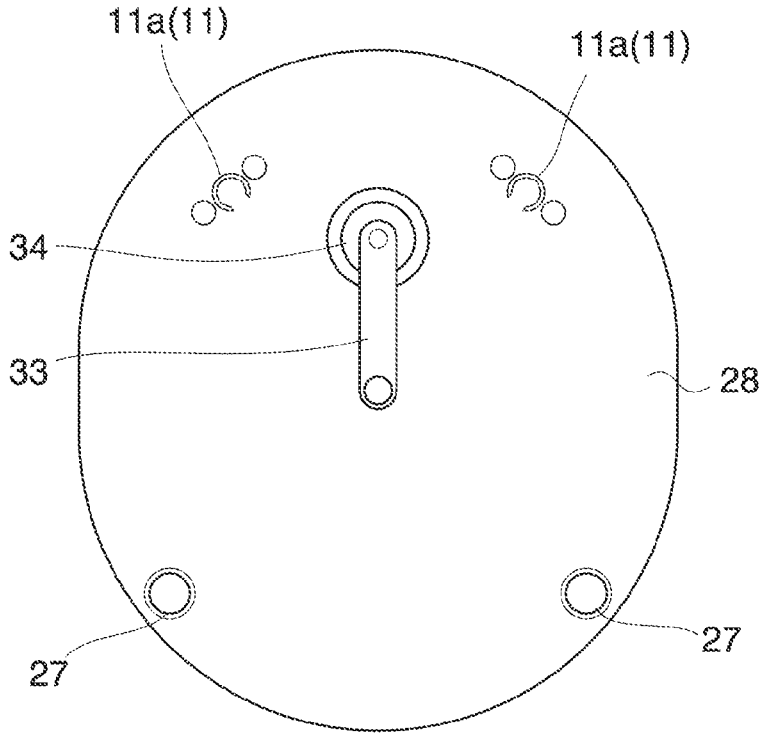
FIG. 15 is a front view showing the detail of the base end member of the guide portion, the base end fixing portion, and the advancing and retracting mechanism in the attaching and detaching fixture of the first embodiment of the invention.

Further, as shown in FIG. 4, in the guide portion 11, the front end 21*a* of the base end member 21 is connected to the front end member 20 by the base end fixing portion 25 fixed to the casing 4, and the base end 21*b* is supported by the casing 4. Specifically, as shown in FIGS. 13 to 15, the base end fixing portion 25 includes a second casing attaching plate 26 which serves as an attachment member to be attached to the casing 4 through the first casing attaching plate 23, a support member 27 that protrudes from the second casing attaching plate 26 toward the base end 11*g* of the guide portion 11, and a fixing plate 28 which is provided at the base end of the support member 27 and to which the base end 21*b* of the base end member 21 of the guide portion 11 is connected. The second casing attaching plate 26 is formed in a substantially annular shape along the outer edge of the opening portion 4*a* of the casing 4 so as to correspond to the first casing attaching plate 23. Then, as shown in FIG. 14, the second casing attaching plate 26 is provided with four third penetration holes 26*a* that correspond to four second penetration holes 23*d* formed in the upper member 23*a* and the lower member 23*b* of the first casing attaching plate 23. Then, when the fixing bolt 29 (see FIG. 4) is inserted through the third penetration hole 26*a* and the second penetration hole 23*d* and is threaded into the cover fixing bolt hole 4*b*, the second casing attaching plate 26 may be fixed to the casing 4 with the first casing attaching plate 23 interposed therebetween.

Further, as in the first casing attaching plate 23, the inner peripheral edge of the second casing attaching plate 26 is provided with a connection portion 26*b* which is provided at a position corresponding to the guide portion 11 so as to protrude toward the inner periphery and connect the base end member 21 in an attachable and detachable manner. The structure of the connection portion 26*b* is the same as that of the connection portion 23*e* of the first casing attaching plate 23. In the front end 21*a* of the base end member 21, the guide body 11*a* protrudes by the amount corresponding to the thickness of the second casing attaching plate 26 with respect to the reinforcing member 11*b*, and is fixed by the connection bolt 26*c*. Accordingly, the base end member 21 and the front end member 20 of the guide portion 11 are connected to each other through the first casing attaching plate 23 and the second casing attaching plate 26, and the guide bodies 11*a* of the base end member 21 and the front end member 20 communicate with each other while the ends are butt-connected to each other.

Further, the support member 27 is provided as a pair of support members interposing the axis line L of the combustor 1 while being attached to the casing 4 in the embodiment. Furthermore, the fixing plate 28 fixed to the base end of the support member 27 is a substantially disk-like member, and the support member 27 and the base end 21*b* of the base end member 21 of the guide portion 11 are fixed thereto. That is, in the guide portion 11, the front end 20*a* of the front end member 20 serving as the front end 11*f* as a whole is fixed to the inner surface of the casing 4 by the support pin 22, and the base end 21*b* of the base end member 21 serving as the base end 11*g* as a whole is fixed to the outer surface of the casing 4 to be supported thereto through the second casing attaching plate 26, the support member 27, and the fixing plate 28 constituting the base end fixing portion 25. Furthermore, in the embodiment, the base end 20*b* of the front end member 20 and the front end 21*a* of the base end member 21, that is, the substantially center position of the guide portion 11 is fixed to the outer surface of the casing 4 through the first casing attaching plate 23 and the second casing attaching plate 26 so as to be supported thereto.

Further, the advancing and retracting mechanism 13 is disposed along the guide portion 11, and includes a ball screw 31 that is supported by the fixing plate 28 of the base end fixing portion 25, a nut member 32 that is threaded into the ball screw 31 and is fixed to the tail cylinder 3 in an attachable and detachable manner, and a handle portion 33 that rotates the ball screw 31 about the axis. For example, as shown in FIGS. 8 and 9, the nut member 32 is fixed to the tail cylinder 3 by the same structure as the fixing structure of the moving portion 12 and the tail cylinder 3. The ball screw 31 is supported by the fixing plate 28 through a bearing 34 so as to be rotatable about the axis, and the front end side thereof extends to the inside of the casing 4 so as to penetrate the first casing attaching plate 23 and the second casing attaching plate 26 while the ball screw is attached to the casing 4. Further, the base end of the ball screw 31 penetrates the fixing plate 28 so as to be connected to the handle portion 33, so that the ball screw 31 may be rotated about the axis by the rotation of the handle portion 33.

Next, the detail of the process of assembling the tail cylinder 3 to the inside of the casing 4 using the attaching and detaching fixture 10 of the embodiment will be described.

The process of assembling the tail cylinder 3 largely includes a guide portion supporting step that supports the guide portion 11 to the casing 4, a tail cylinder attaching step that attaches the tail cylinder 3 to the guide portion 11, and a tail cylinder installation step that moves the tail cylinder 3 attached to the guide portion 11 along the guide portion 11 so as to be connected to an inlet portion 203*a* of a combustion gas passageway 203.

Further, in the embodiment, since the guide portion 11 includes the front end member 20 and the base end member 21, the guide portion supporting step includes a first support step that supports the front end member 20 to the casing 4 and a second support step that supports the base end member 21 to the casing 4 while the base end member is connected to the front end member 20.

Hereinafter, the detail will be described.

Figure 16:
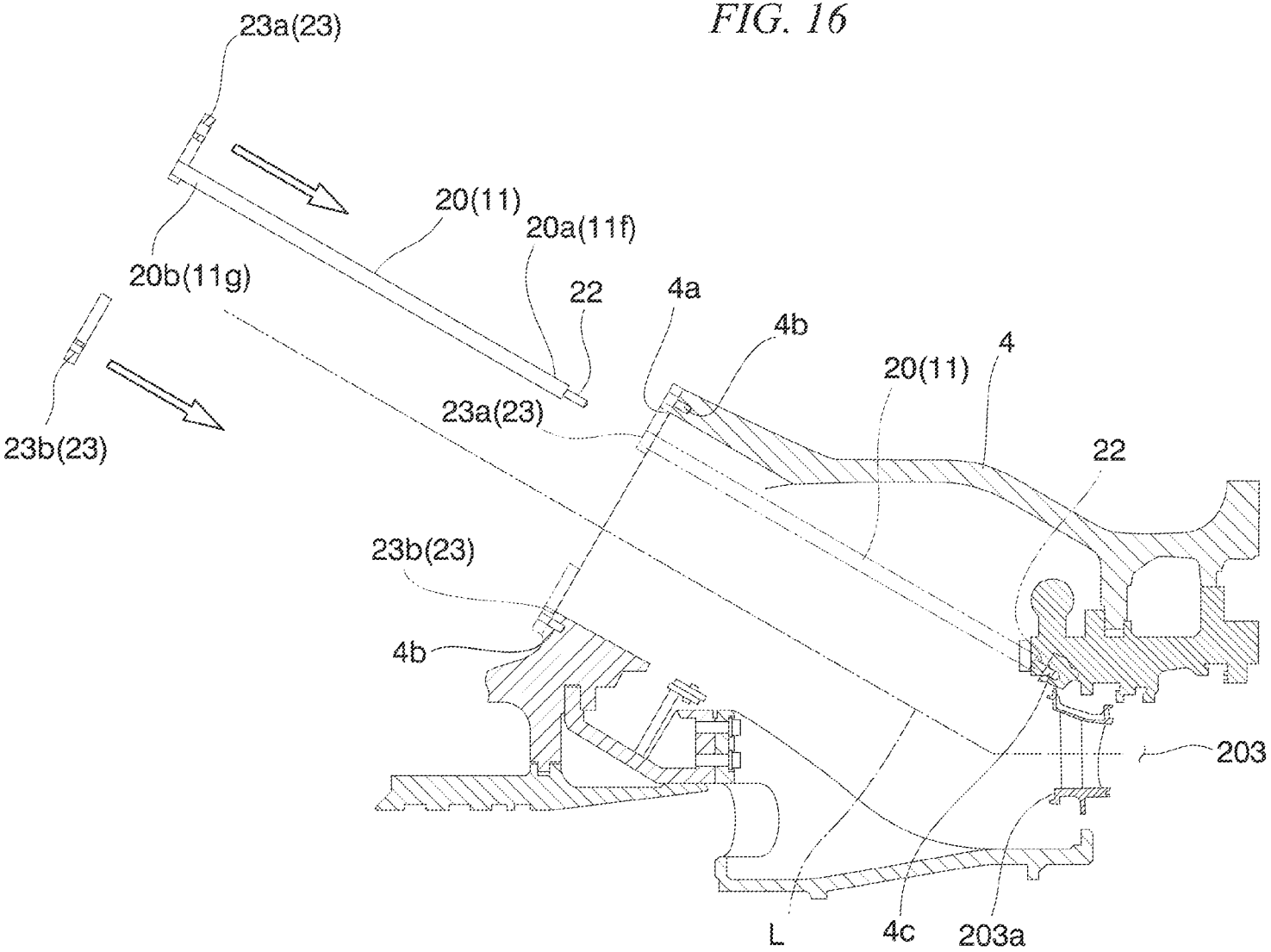
FIG. 16 is a diagram illustrating a first support step in a tail cylinder attaching method of the first embodiment of the invention.

First, the first support step is performed. That is, as shown in FIG. 16, the base end 20*b* of the front end member 20 is connected to the upper member 23*a* of the first casing attaching plate 23 by the connection bolt 23*k*. Next, the front end member 20 integrated with the upper member 23*a* is inserted from the opening portion 4*a* into the casing 4. At this time, if necessary, the front end member 20 and the upper member 23*a* is suspended on a crane to be transferred to a desired position, and they are inserted while being minutely adjusted by an operator. Furthermore, the construction method will be described later in which the combustor 1 cannot be transferred at the lower position by being suspended on the crane due to the inference of the casing 4.

Then, the support pin 22 of the front end of the front end member 20 inserted into the casing 4 is fitted to the concave portion 4*c* formed on the inner surface of the casing 4. In this state, since the length of the front end member 20 is set to match the depth of the inside of the casing 4, the upper member 23*a* of the first casing attaching plate 23 connected to the base end 20*b* of the front end member 20 comes into contact with the outer edge of the opening portion 4*a* of the casing 4.

Then, in this state, when the operator inserts the fixing bolt 24 through the first penetration hole 23*c* of the first casing attaching plate 23 so as to be threaded into the cover fixing bolt hole 4*b* of the casing 4, the upper member 23*a* and the front end member 20 of the first casing attaching plate 23 are fixed to the casing 4. Further, the lower member 23*b* of the first casing attaching plate 23 is threaded and fixed to the cover fixing bolt hole 4*b* by the fixing bolt 24 in the same manner.

Here, in the embodiment, since the first casing attaching plate 23 is divided into the upper member 23*a* and the lower member 23*b*, the weight of the member to be attached in each attachment work may be decreased so as to make the work easy. Further, since the upper member 23*a* and the front end member 20 of the first casing attaching plate 23 are also separate members, they may be easily transferred. If necessary, only the front end member 20 is first inserted into the casing 4 in advance, and the front end member 20 and the upper member 23*a* may be connected to each other in the vicinity of the opening portion 4*a* of the casing 4.

Figure 17:
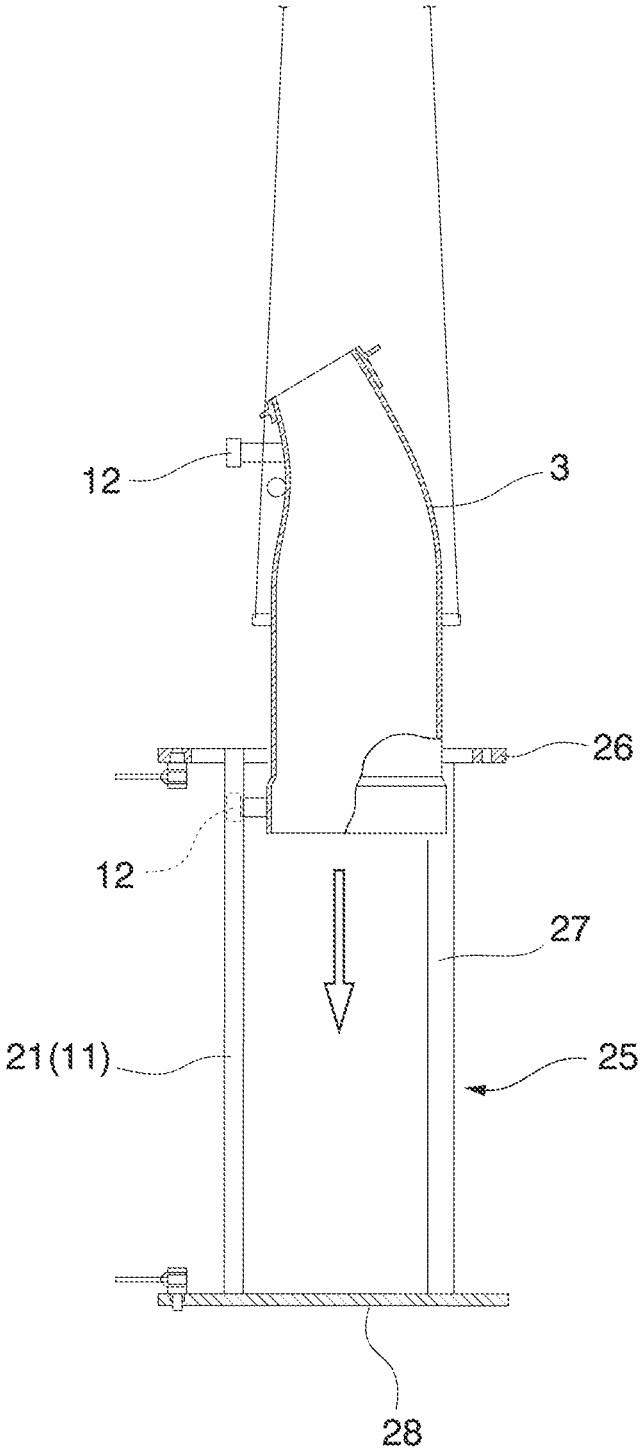
FIG. 17 is a diagram illustrating a tail cylinder attaching step in the tail cylinder attaching method of the first embodiment of the invention.

Further, the first support step is performed. Then, as shown in FIG. 17, the tail cylinder 3 is attached to the base end member 21 of the guide portion 11 in the tail cylinder attaching step.

First, the second casing attaching plate 26, the support member 27, and the fixing plate 28 constituting the base end fixing portion 25 and the base end member 21 of the guide portion 11 are assembled in advance. Then, the base end fixing portion 25 and the base end member 21 of the guide portion 11 are disposed so that the second casing attaching plate 26 is positioned at the upper side. Further, the moving portion 12 is attached to the tail cylinder 3. Next, a lifting tool is engaged with the tail cylinder 3 so as to be lifted in a suspended manner by the crane in the state where the front end is positioned at the upper side and the base end is positioned at the lower side. Then, the suspended and lifted tail cylinder 3 is lifted down from the upside of the second casing attaching plate 26, so that the tail cylinder 3 is inserted from the center opening of the second casing attaching plate 26, and then the moving body 12*a* of the moving portion 12 is inserted into the guide body 11*a* of the base end member 21 of which the end is opened to the second casing attaching plate 26. Then, when the tail cylinder 3 is disposed between the fixing plate 28 and the second casing attaching plate 26, the tail cylinder 3 is temporarily fixed to the base end member 21 so as to be transferred in a batch. Then, the advancing and retracting mechanism 13 is assembled. That is, the nut member 32 is threaded into the ball screw 31 in advance, and the base end is inserted through the bearing 34 of the fixing plate 28, so that the handle portion 33 is assembled. Next, the position of the nut member 32 is minutely adjusted while the handle portion 33 is rotated, so that the handle portion is positioned and fixed to the fixing position of the tail cylinder 3.

Figure 18:
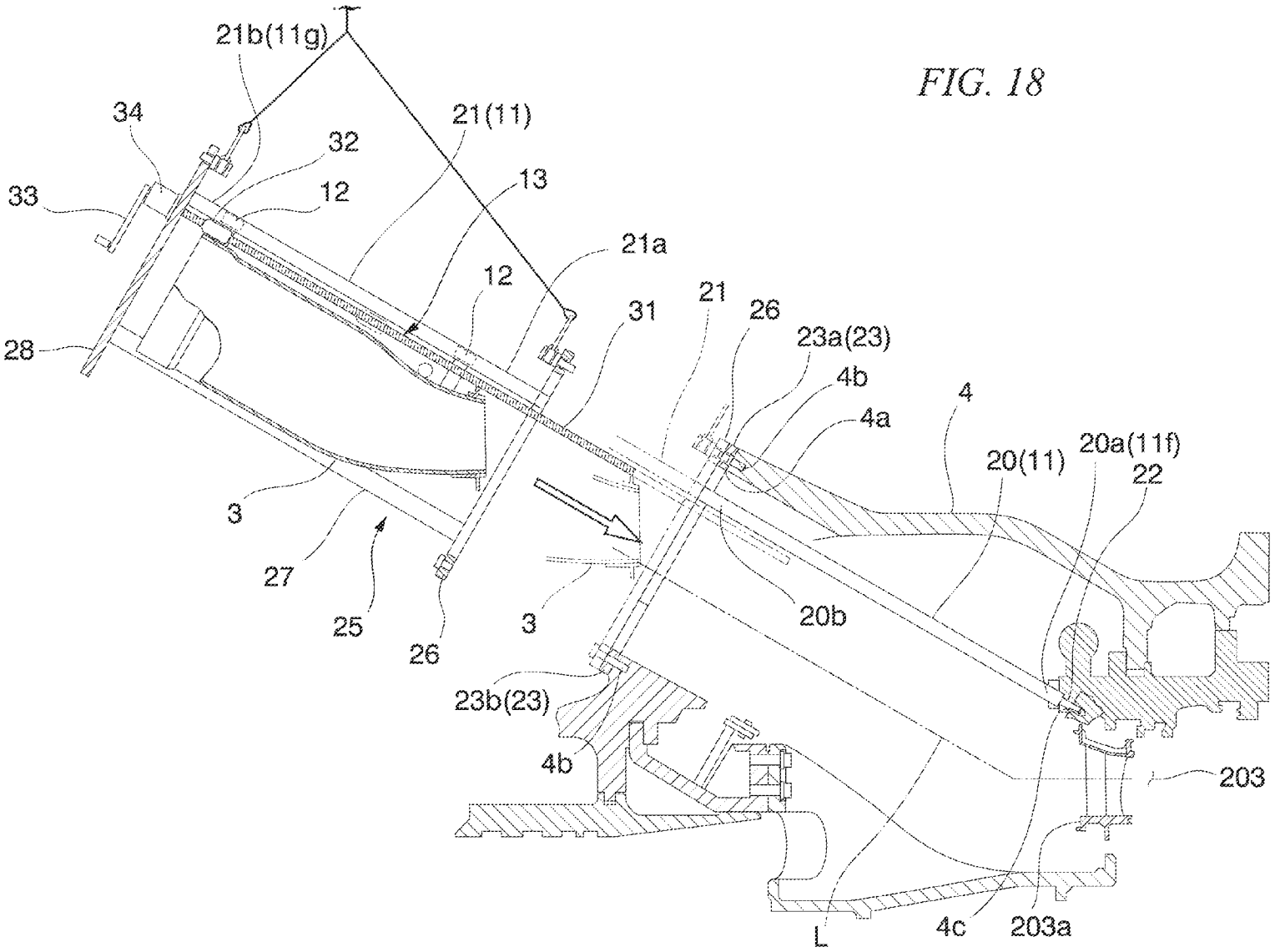
FIG. 18 is a diagram illustrating a second support step in the tail cylinder attaching method of the first embodiment of the invention.

Next, as the second support step, the base end member 21 is connected to the front end member 20. That is, as shown in FIG. 18, the base end fixing portion 25, the base end member 21, the advancing and retracting mechanism 13, and the tail cylinder 3 which are integrated with each other at the tail cylinder attaching step are suspended on the crane and are transferred to a desired position.

The transfer operation is assisted by the operator's hand to perform a minute adjustment if necessary so that the second casing attaching plate 26 comes into contact with the first casing attaching plate 23 and the front end member 20 and the base end member 21 are butt-connected to each other. Then, in this state, the fixing bolt 29 is inserted through the third penetration hole 26*a* and the second penetration hole 23*d* and is threaded into the cover fixing bolt hole 4*b* by the operator's hand. Accordingly, the base end member 21 and the front end member 20 are integrated as the guide portion 11, so that the front end 11*f* is supported to the inner surface of the casing 4 and the base end 11*g* is supported to the outer surface of the casing 4. Then, the tail cylinder 3 may be moved along the guide portion 11 in the direction of the axis line L of the combustor 1. Furthermore, as in the first support step, the construction method will be described later in which the combustor 1 cannot be transferred at the lower position by being suspended on the crane due to the inference of the casing 4.

Figure 19:
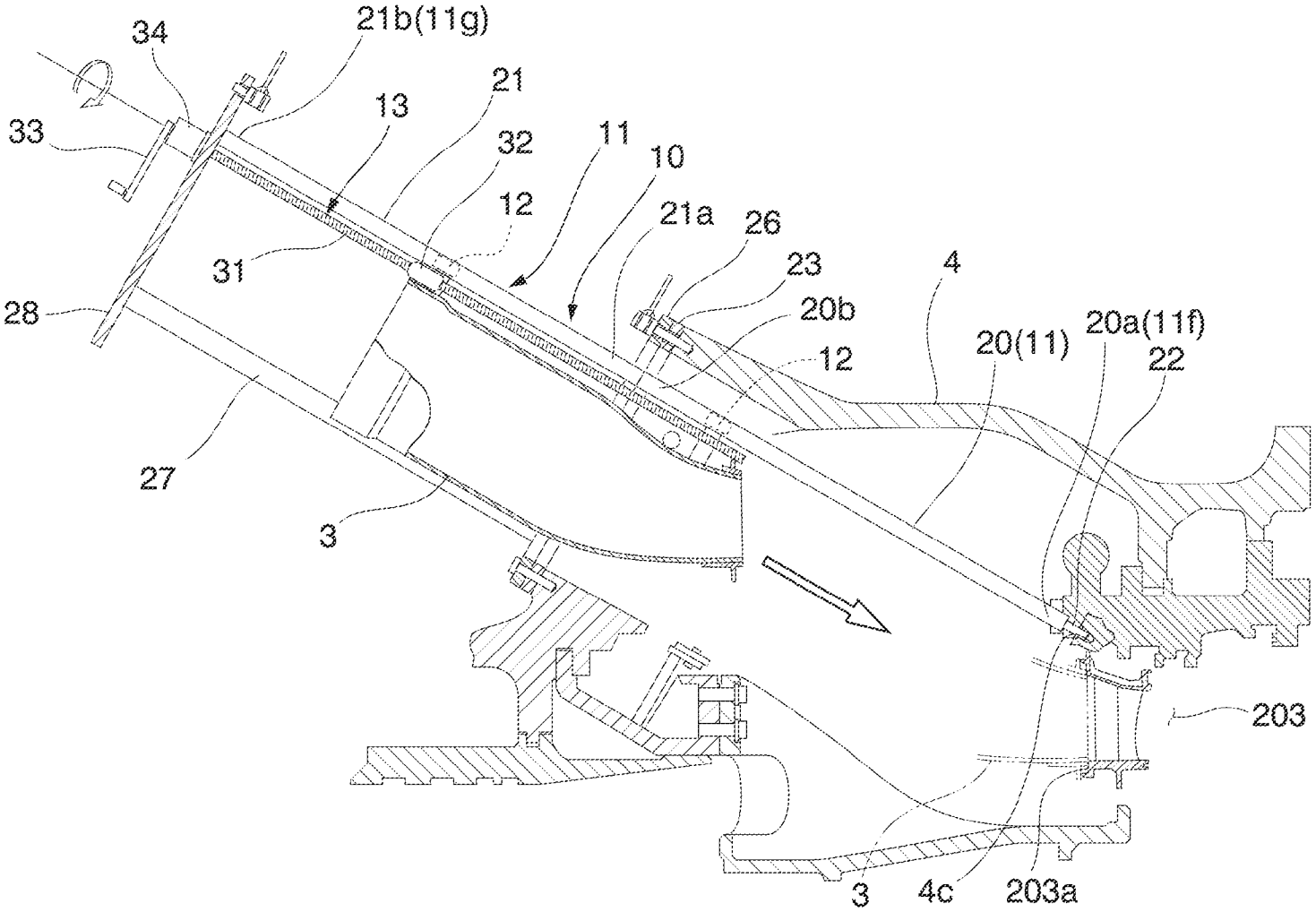
FIG. 19 is a diagram illustrating a tail cylinder installation step in the tail cylinder attaching method of the first embodiment of the invention.

Next, as shown in FIG. 19, as the tail cylinder installation step, the tail cylinder 3 is connected to the inlet portion 203*a* of the combustion gas passageway 203. That is, when the handle portion 33 of the advancing and retracting mechanism 13 is rotated so as to rotate the ball screw 31 about the axis, the tail cylinder 3 is made to advance inside the casing 4 together with the nut member 32. Then, when the front end of the tail cylinder 3 comes into contact with the inlet portion 203*a* of the combustion gas passageway 203, the front end is fixed to the casing 4 in a manner such that the operator waiting inside the casing 4 attaches a fixing member thereto.

Finally, as the removal step, the guide portion 11, the advancing and retracting mechanism 13, and the base end fixing portion 25 are detached. That is, first, the fixed state between the nut member 32 of the advancing and retracting mechanism 13 and the tail cylinder 3 and the fixed state between the fixing portion 12*c* of the moving portion 12 and the tail cylinder 3 are released. At this time, as shown in FIGS. 8 and 9, since they are fixed only by the engagement between the key 14*b* and the key groove 3*b*, the fixed state may be easily released even inside the narrow casing 4 only by rotating the fixture 14 about the axis. Then, the base end fixing portion 25 and the base end member 21 which are integrated with each other are suspended on the crane, and then the fixing bolt 29 of the second casing attaching plate 26 of the base end fixing portion 25 is detached. Then, the base end fixing portion 25 and the base end member 21 are transferred to the other working area by the crane, and are disassembled. Further, finally, the fixing bolt 24 of the first casing attaching plate 23 is detached while the first casing attaching plate 23 is suspended on the crane. In this state, the front end member 20 is extracted from the inside of the casing 4 by the crane in accordance with the guide of the operator, so that the assembly of the tail cylinder 3 is completed.

As described above, in the attaching and detaching fixture 10 of the embodiment, since the guide portion 11 is supported to both ends, the front end 11*f* and the base end 11*g* instead of being supported to the casing 4 in a cantilevered structure, it is possible to support the tail cylinder 3 so as to be stable and movable in the direction of the axis line L of the combustor 1 by the guide portion 11 with the minimal size. Furthermore, in the embodiment, since the guide portion 11 is supported to the substantially center position which is the connection portion between the base end member 21 and the front end member 20, it is possible to further shorten the length of the member. Further, since the advancing and retracting mechanism 13 advancing and retracting the tail cylinder 3 in the direction of the axis line L of the combustor 1 is formed to be separated from the guide portion 11 supports the tail cylinder 3 so as to be movable in the direction of the axis line L of the combustor 1, it is possible to obtain a compact and simple structure overall without unnecessarily increasing the size of the advancing and retracting mechanism 13. For this reason, even in a restricted working space, the guide portion 11 and the advancing and retracting mechanism 13 may be installed, and the tail cylinder 3 may be inserted and attached to the inside of the casing 4. Further, in the above-description, a process has been described in which the tail cylinder 3 is assembled by using the attaching and detaching fixture 10. However, even in the process of detaching the assembled tail cylinder 3, the process may be performed basically in the reverse sequence, and the tail cylinder 3 may be easily detached from the inside of the casing 4 even in a restricted space. Further, since the tail cylinder 3 may be attached and detached even in a restricted space, in the replacement work after starting the service of the gas turbine 200, a desired one may be selectively replaced in the plurality of combustors 1 without detaching a pipe 8 disposed in the periphery of the combustor 1.

In particular, in the embodiment, the guide portion 11 is formed as two members, the front end member 20 and the base end member 21 which are attachable to each other and detachable from each other. For this reason, it is possible to shorten the length of each member, reduce the weight thereof, and enable installation thereof in a narrower space. Furthermore, after the tail cylinder attaching step is performed in advance, in the second support step, the tail cylinder 3 may be installed to be fixed to the base end member 21 constituting the guide portion 11, and the attachment work of the tail cylinder 3 which is a heavy component may be performed under better working conditions.

Further, in the embodiment, as described above, since the base end member 21 forming a part of the base end 11*g* of the guide portion 11 protrudes outward from the casing 4, in the tail cylinder installation step, the tail cylinder 3 may be more stably moved between the outside and the inside of the casing 4. Further, the base end fixing portion 25 fixing the base end 11*g* of the guide portion 11 is fixed by using the cover fixing bolt hole 4*b* fixing the cover body 7 (see FIG. 1) used to block the opening portion 4*a* of the casing 4. For this reason, the simple structure may be obtained without further providing new means for fixing the base end fixing portion 25 to the outer surface of the casing 4.

Figure 20:
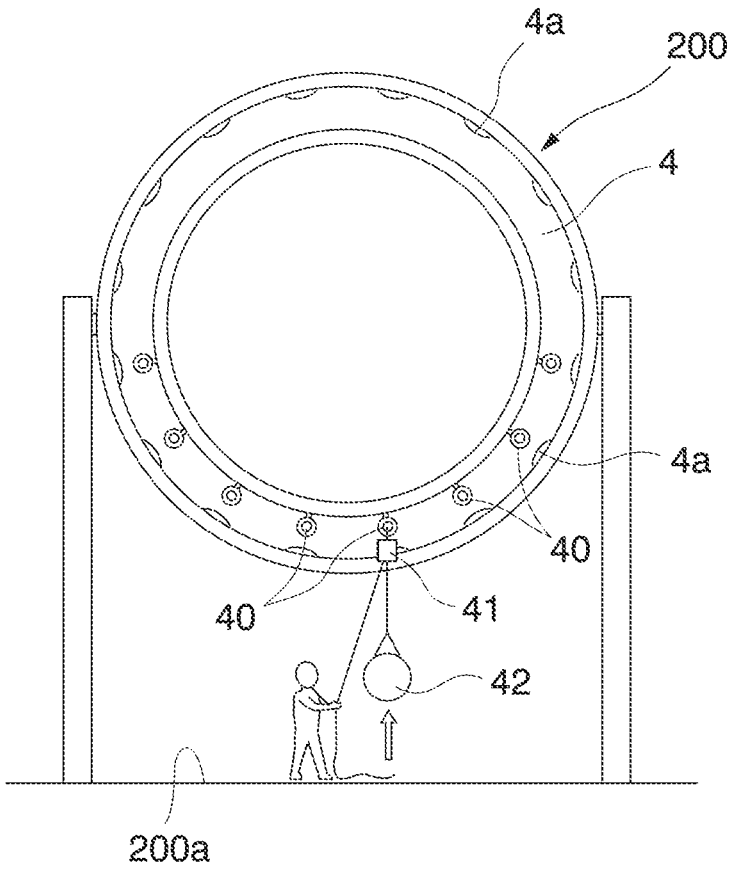
FIG. 20 is a diagram illustrating a tail cylinder attaching and detaching work at the lower side of a turbine rotor in the tail cylinder attaching method of the first embodiment of the invention.
Figure 21:
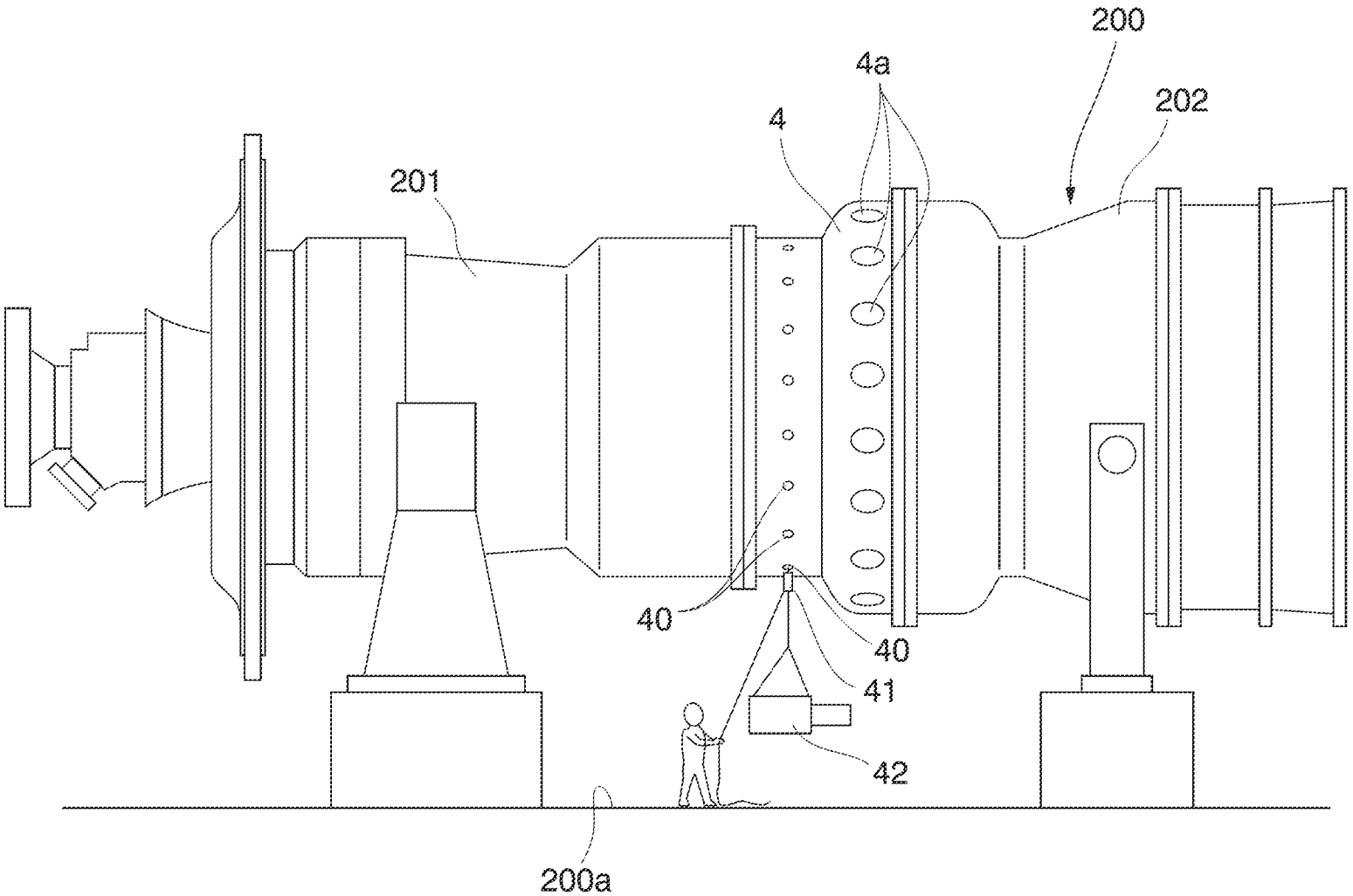
FIG. 21 is a diagram illustrating the tail cylinder attaching and detaching work at the lower side of the turbine rotor in the tail cylinder attaching method of the first embodiment of the invention.
Figure 22:
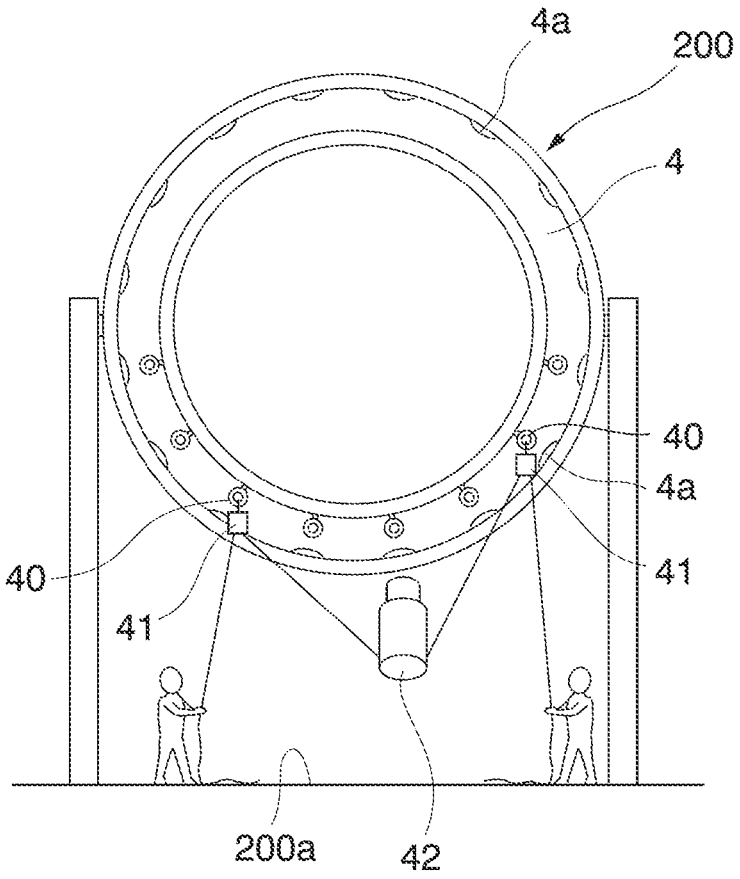
FIG. 22 is a diagram illustrating the tail cylinder attaching and detaching work at the lower side of the turbine rotor in the tail cylinder attaching method of the first embodiment of the invention.
Figure 23:
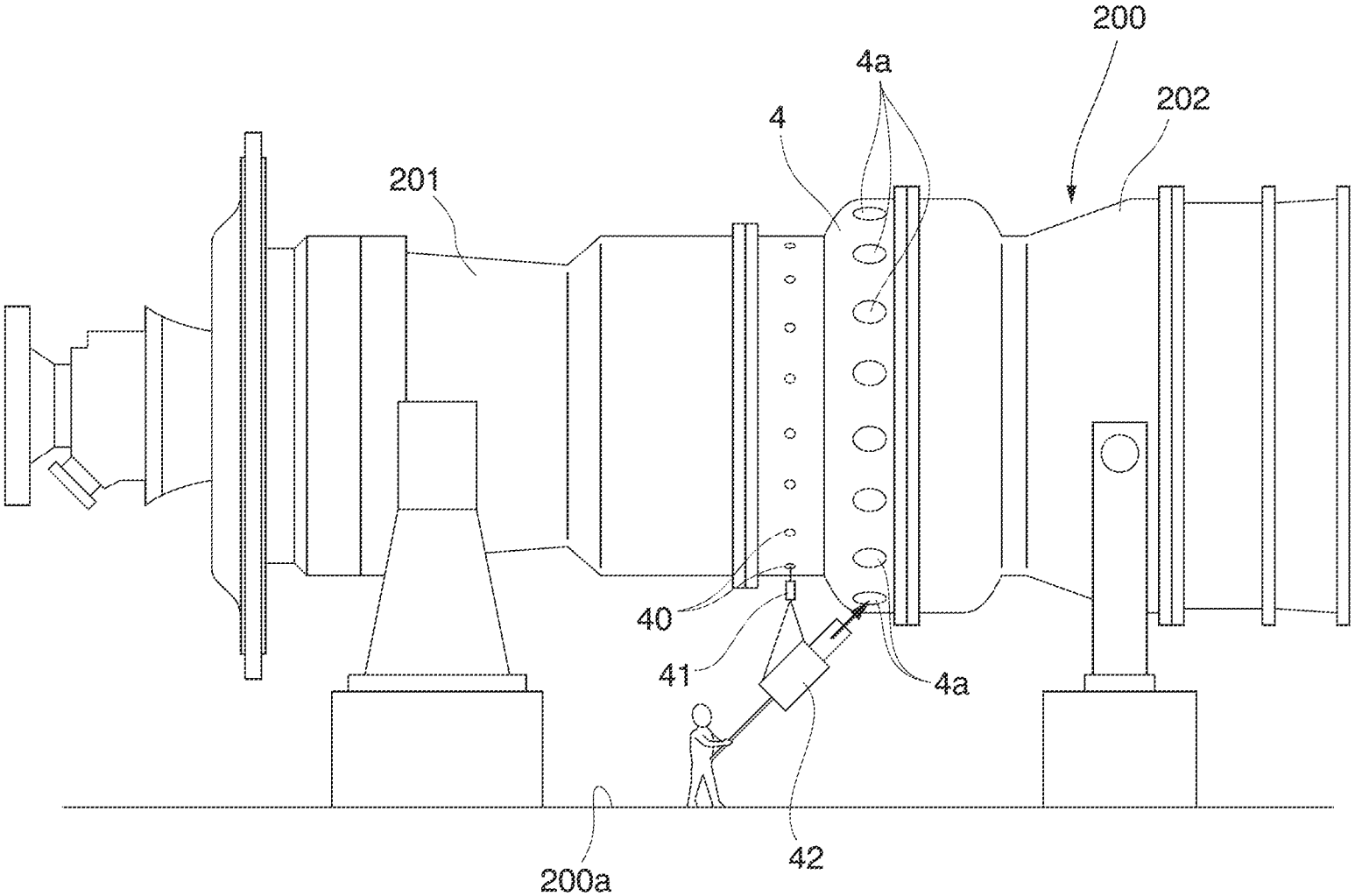
FIG. 23 is a diagram illustrating the tail cylinder attaching and detaching work at the lower side of the turbine rotor in the tail cylinder attaching method of the first embodiment of the invention.

Furthermore, in the first support step and the second support step, a member as an object is suspended on the crane and is attached to the casing 4. However, in the case of the combustor 1 disposed at the lower side of the turbine rotor, the member is transferred by the crane to the vicinity of the range where the member may be transferred by the crane, and the member is attached using other means, and the removing work is performed. Specifically, as shown in FIGS. 20 and 21, a plurality of engagement means, for example, eyebolts 40 are arranged in an annular shape in the vicinity of the combustor 1 positioned below the turbine rotor which is an object so as to correspond to the arrangement of the combustors 1. A lifting tool, for example, a chain block 41 engages with the eyebolt 40. Then, the object 42 is transferred by the crane to the vicinity using the chain block 41. For example, the object in which the base end member 21, the base end fixing portion 25, and the tail cylinder 3 are integrated with each other are suspended and lifted. Next, as shown in FIGS. 22 and 23, other chain blocks 41 engage with other eyebolts 40 positioned at both left and right sides of the suspended and lifted object 42, so that the object 42 is suspended thereon. Then, when the position of the object 42 is adjusted laterally and vertically by the two chain blocks 41, the object may be installed at the opening portion 4*a* of the casing 4.

Further, in the above-described embodiment, a specific structure has been described as an example of the moving mechanism using the guide portion 11 and the moving portion 12 and the advancing and retracting mechanism 13, but the invention is not limited thereto. Hereinafter, the modified examples of the respective mechanisms will be described.

Figure 24:
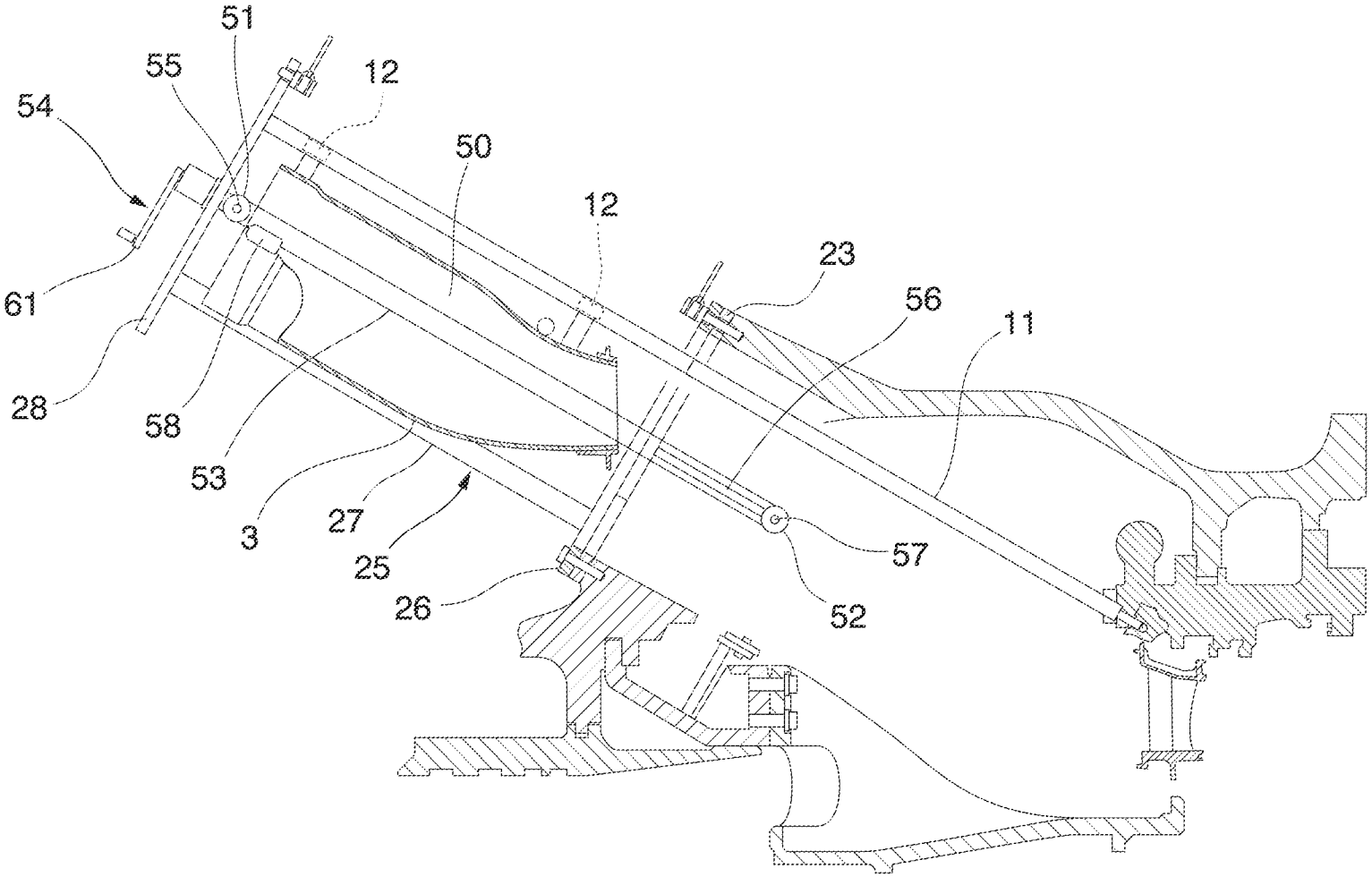
FIG. 24 is a cross-sectional view showing a state where an attaching and detaching fixture of a first modified example of the first embodiment of the invention is attached to the casing.
Figure 25:
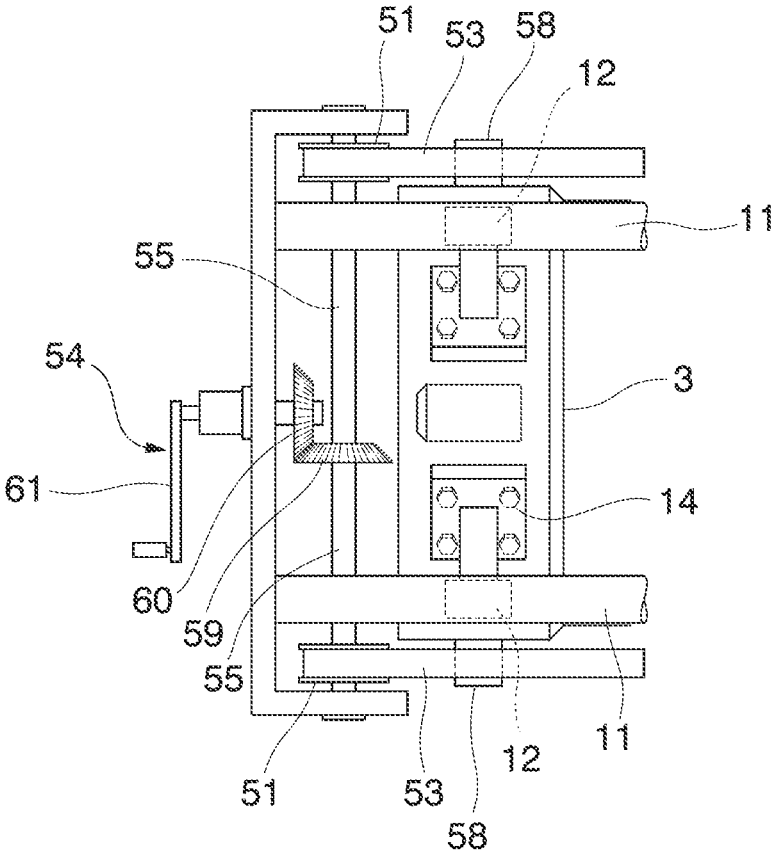
FIG. 25 is a cross-sectional view showing the detail of a driving portion in the attaching and detaching fixture of the first modified example of the first embodiment of the invention.

FIGS. 24 and 25 show the modified example of the advancing and retracting mechanism as the first modified example of the embodiment. An advancing and retracting mechanism 50 of the modified example includes a first pulley 51 that is rotatably supported by the fixing plate 28, a second pulley 52 that is rotatably supported by the first casing attaching plate 23, an endless belt 53 that is wound between the first pulley 51 and the second pulley 52, and a driving portion 54 that rotates the first pulley 51. The first pulley 51 is provided in a first rotary shaft 55 that is perpendicular to the axis line L of the combustor 1 while being attached to the casing 4 and is rotatably supported by the fixing plate 28. Further, a support frame 56 protrudes from the first casing attaching plate 23 toward the inside of the casing 4 while being attached to the casing 4. Then, a second rotary shaft 57 is rotatably supported by the front end of the support frame 56 so as to be perpendicular to the direction of the axis line L of the combustor 1, and the second rotary shaft 57 is provided with the second pulley 52. Then, the endless belt 53 is wound between the first pulley 51 and the second pulley 52 so as to travel in the direction of the axis line L of the combustor 1. Further, a slider 58 is fixed to one position of the endless belt 53, and is attachably and detachably connected to the tail cylinder 3.

Further, the driving portion 54 includes a first bevel gear 59 that is coaxially attached to the first rotary shaft 55, a second bevel gear 60 that is rotatably supported by the fixing plate 28 so that the axis line is substantially parallel to the axis line L of the combustor 1 and meshes with the first bevel gear 59, and a handle portion 61 that rotates the second bevel gear 60. For this reason, when the handle portion 61 is rotated, the first pulley 51 is rotated through the second bevel gear 60 and the first bevel gear 59, so that the endless belt 53 may travel. Then, when the endless belt 53 travels so that the slider 58 moves between the first pulley 51 and the second pulley 52, the tail cylinder 3 may be advanced and retracted in the direction of the axis line L of the combustor 1. Furthermore, in the embodiment, two sets of structures including the first pulley 51, the second pulley 52, the endless belt 53, and the slider 58 are provided with the tail cylinder 3 interposed therebetween, thereby more stably moving the tail cylinder 3.

Further, FIGS. 26 to 29 show the second to fourth modified examples of the embodiment, which shows the modified example of the moving mechanism that moves the tail cylinder 3 in the direction of the axis line L of the combustor 1.

Figure 26:
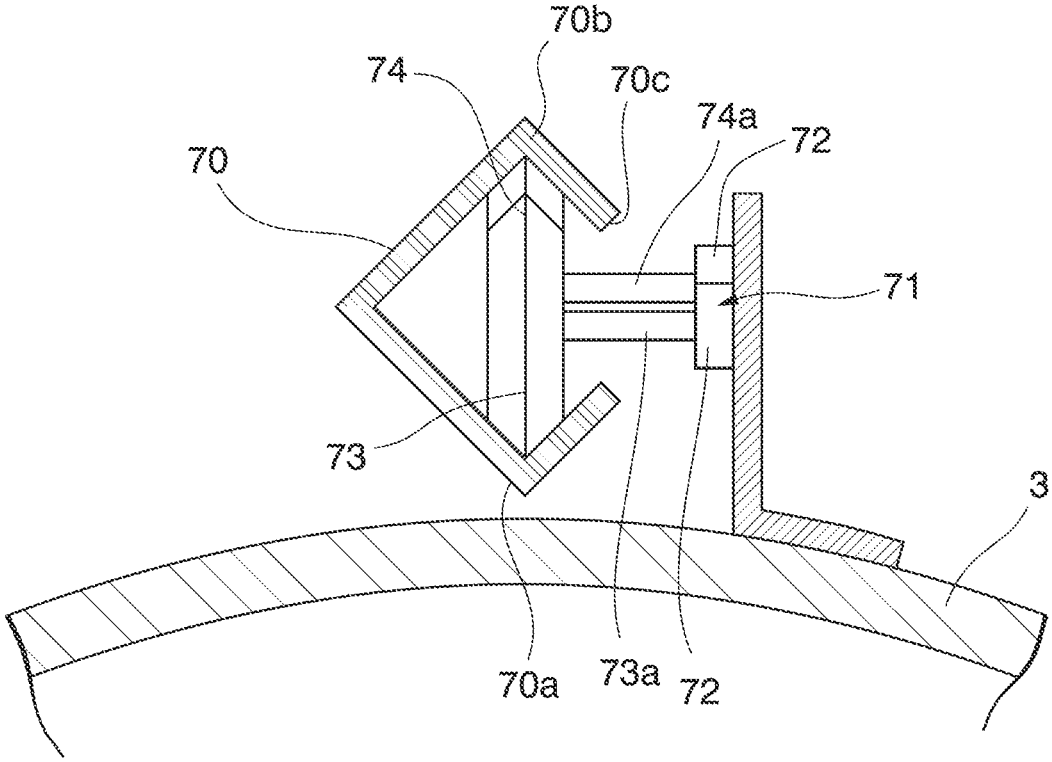
FIG. 26 is a front cross-sectional view showing the detail of a guide portion and a moving portion in an attaching and detaching fixture of a second modified example of the first embodiment of the invention.
Figure 27:
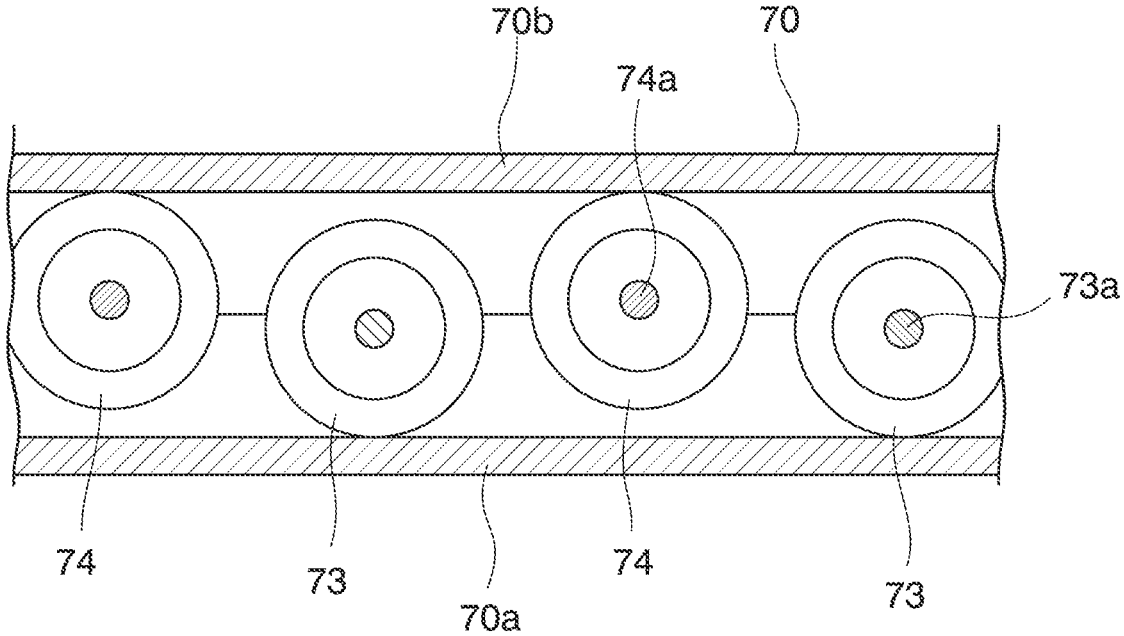
FIG. 27 is a side cross-sectional view showing the detail of the guide portion and the moving portion in the attaching and detaching fixture of the second modified example of the first embodiment of the invention.

As shown in FIGS. 26 and 27, in the second modified example, a guide portion 70 is formed so as to have a substantially C-shaped cross-section which is opened at one position so that a moving portion 71 attachably and detachably connected to the tail cylinder 3 is insertable therethrough as in the above-described embodiment. However, more specifically, a position of a rectangular pipe with opposite corners 70*a* and 70*b* is notched. Further, the moving portion 71 includes a fixing portion 72 that is attachably and detachably connected to the tail cylinder 3 and rollers 73 and 74 that are rotatably supported by the fixing portion 72 through rotary shafts 73*a* and 74*a*. At least one of the rollers 73 and 74 is provided as many as the number of two or more so that they are alternately arranged, and when the rotary shafts 73*a* and 74*a* are inserted through the gap 70*c* of the guide portion 70, they are inserted into the guide portion 70. Here, the rollers 73 and 74 are all formed so as to have a diameter smaller than the inner dimension between the corners 70*a* and 70*b* of the guide portion 70, and are deviated from each other in the direction perpendicular to the arrangement direction, so that one roller 73 comes into contact with one corner 70*a* and the other roller 74 comes into contact with the other corner 70*b*.

Even with using the moving mechanism, the tail cylinder 3 connected to the moving portion 71 may be supported by the guide portion 70, and the tail cylinder 3 may be moved along the guide portion 70 by the rolling actions of the rollers 73 and 74 of the moving portion 71. Here, the rollers 73 and 74 are set to be smaller than the inner dimension of the corners 70*a* and 70*b* of the guide portion 70, and hence the fitting structure is not adopted. Accordingly, it is possible to reduce the friction between the guide portion 70 and the rollers 73 and 74 and smoothly move the tail cylinder 3.

Figure 28:
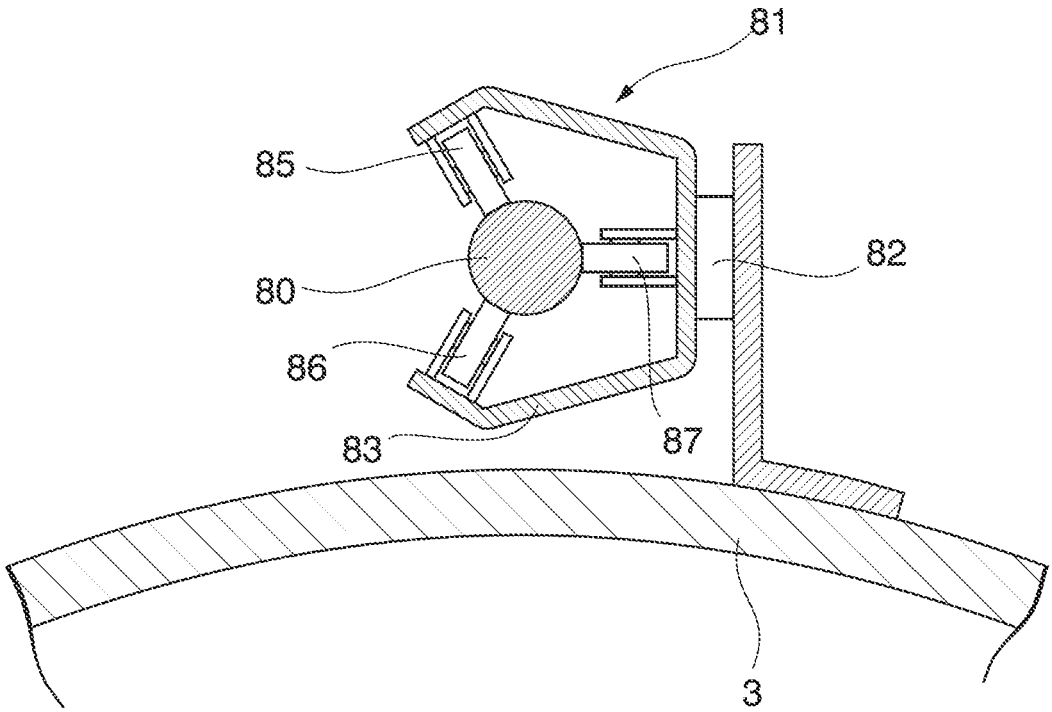
FIG. 28 is a front cross-sectional view showing the detail of a guide portion and a moving portion in an attaching and detaching fixture of a third modified example of the first embodiment of the invention.

As shown in FIG. 28, in the third modified example, a guide portion 80 is formed in a cylindrical shape. Further, the moving portion 81 includes a fixing portion 82 that is attachably and detachably connected to the tail cylinder 3, a support portion 83 that is supported by the fixing portion 82 and has a substantially U-shape, and rollers 84, 85, and 86 that are rotatably supported by the support portion 83. Here, the rollers 84, 85, and 86 are arranged in an annular shape so as to support the cylindrical guide portion 80 from three positions. Even in this structure, the tail cylinder 3 may be supported by the guide portion 80, and the tail cylinder 3 may be moved along the guide portion 80 by the rolling actions of the rollers 84, 85, and 86.

Figure 29:
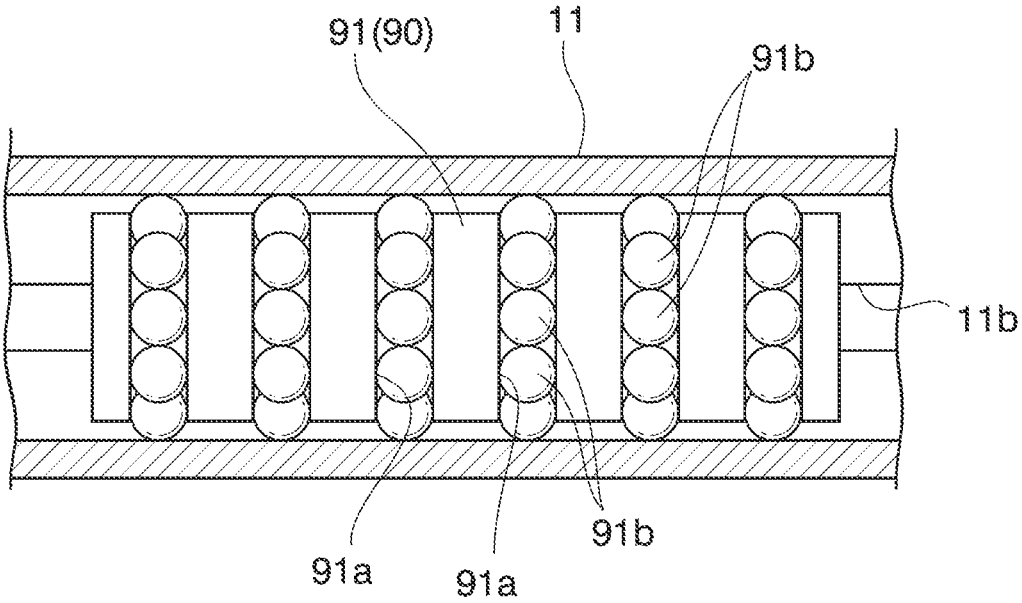
FIG. 29 is a side cross-sectional view showing the detail of a guide portion and a moving portion in an attaching and detaching fixture of a fourth modified example of the first embodiment of the invention.

As shown in FIG. 29, in a fourth modified example, since a moving body 91 of a moving portion 90 is inserted into the guide portion 11 having a substantially C-shaped cross-section, the tail cylinder is movable along the guide portion 11. This point is the same as that of the above-described embodiment. However, this modified example is different in that an annular groove 91*a* is formed in the outer peripheral surface of the cylindrical moving body 91 and a plurality of balls 91*b* is fitted into the groove 91*a* so as to roll therein. In the structure of the modified example, the balls 91*b* roll when the moving portion 90 moves inside the guide portion 11, so that the tail cylinder 3 may be more smoothly moved along the guide portion 11.

Figure 30:
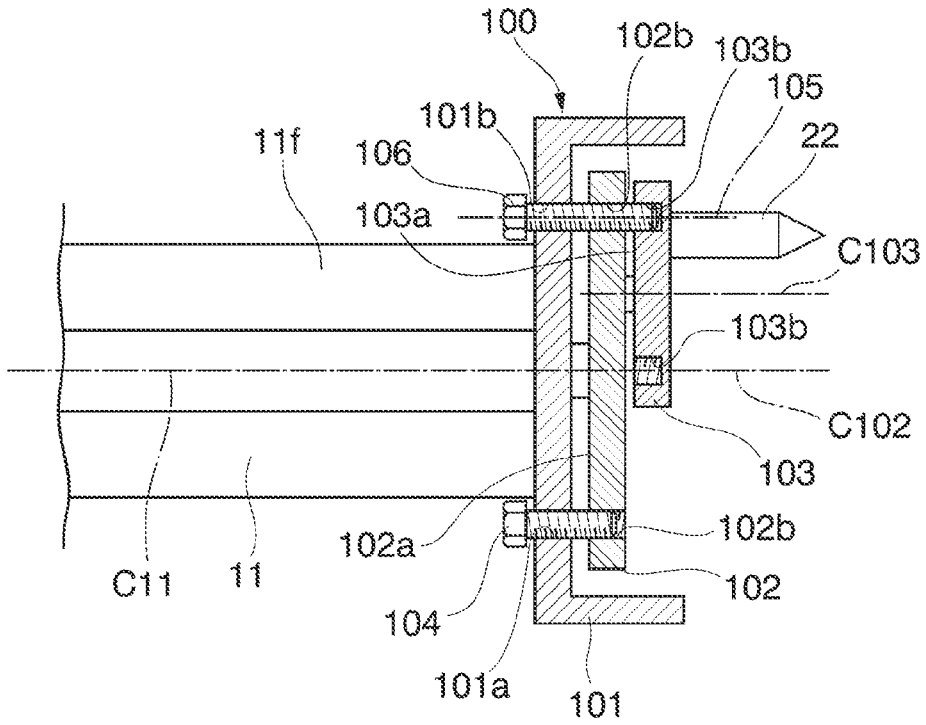
FIG. 30 is a side cross-sectional view showing the detail of a front end of a guide portion in an attaching and detaching fixture of a fifth modified example of the first embodiment of the invention.
Figure 31:
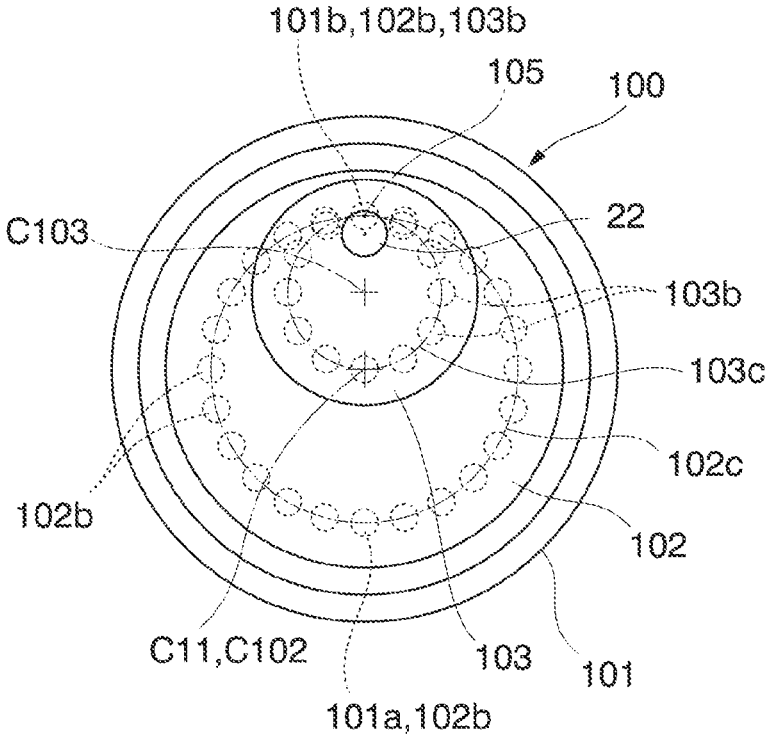
FIG. 31 is a front cross-sectional view showing the detail of the front end of the guide portion in the attaching and detaching fixture of the fifth modified example of the first embodiment of the invention.

Further, FIGS. 30 and 31 show a fifth modified example, which shows the modified example of the support structure in the front end 11*f* of the guide portion 11.

As shown in FIGS. 30 and 31, a support position adjusting mechanism 100 is provided in the front end 11*f* of the guide portion 11. The support position adjusting mechanism 100 includes a first support body 101 that is fixed to the front end 11*f* of the guide portion 11 and has a substantially disk-shape, a second support body 102 that is rotatably supported by the first support body 101 and has a substantially disk-shape, and a third support body 103 which is rotatably supported by the second support body 102 and has a substantially disk-shape and to which a support pin 22 is fixed.

The second support body 102 is provided so that the rotation center C102 is coaxial with the axis line C11 of the guide portion 11. Further, a surface 102*a* facing the first support body 101 in the second support body 102 is provided with a plurality of first position adjusting bolt holes 102*b* formed along the outer periphery in an annular shape. Further, the first support body 101 is provided with a first bolt inserting hole 101*a* that has the center positioned on a circular arc 102*c* connecting the centers of the first position adjusting bolt hole 102*b*. For this reason, it is possible to select the first position adjusting bolt hole 102*b* that communicates with the first bolt inserting hole 101*a* by rotating the second support body 102. Then, when the first position adjusting bolt 104 is inserted through the first bolt inserting hole 101*a* so as to be threaded into the communicating first position adjusting bolt hole 102*b*, the second support body 102 may be positioned about its rotation center C102 with respect to the first support body 101.

Further, the rotation center C103 of the third support body 103 is set to a position which is a middle point in a line connecting the rotation center C102 of the second support body 102 and the center of the first position adjusting bolt hole 102*b*. Further, a surface 103*a* facing the second support body 102 in the third support body 103 is provided with a plurality of second position adjusting bolt holes 103*b* which is formed along the outer periphery in an annular shape. Here, the diameter of the circular-arc 103*c* connecting the centers of the second position adjusting bolt hole 103*b* is set to be equal to the radius of the circular-arc 102*c* connecting the centers of the first position adjusting bolt hole 102*b*. For this reason, it is possible to select the second position adjusting bolt hole 102*b* communicating with the first position adjusting bolt hole 102*b* at the position 105 which is the outermost side from the axis line C11 of the guide portion 11 by rotating the second support body 102.

Further, at the position 105, the first support body 101 is provided with a second bolt inserting hole 101*b* that communicates with the first position adjusting bolt hole 102*b* and the second position adjusting bolt hole 103*b*. For this reason, when the second position adjusting bolt 106 is inserted through the second bolt inserting hole 101*b* so as to be threaded into the first position adjusting bolt hole 102*b* and the second position adjusting bolt hole 103*b*, the third support body 103 may be positioned about the rotation center C103 with respect to the second support body 102. Then, since the support pin 22 is provided so as to be eccentric with respect to the rotation center C103 of the third support body 103, it is possible to adjust the position of the support pin 22 with respect to the axis line C11 of the guide portion 11 by adjusting the relative position between the first support body 101, the second support body 102, and the third support body 103.

Then, when the position of the support pin 22 is adjusted about the axis line with respect to the guide portion 11, the relative positional relationship between the guide portion 11 and the casing 4 may be adjusted while the support pin 22 is fitted to the concave portion 4*c* so that the guide portion 11 is attached to the casing 4. For this reason, it is possible to accurately and more easily connect the tail cylinder 3 supported by the guide portion 11 using the inlet portion 203*a* of the combustion gas passageway 203 inside the casing 4.

Second Embodiment

Figure 32:
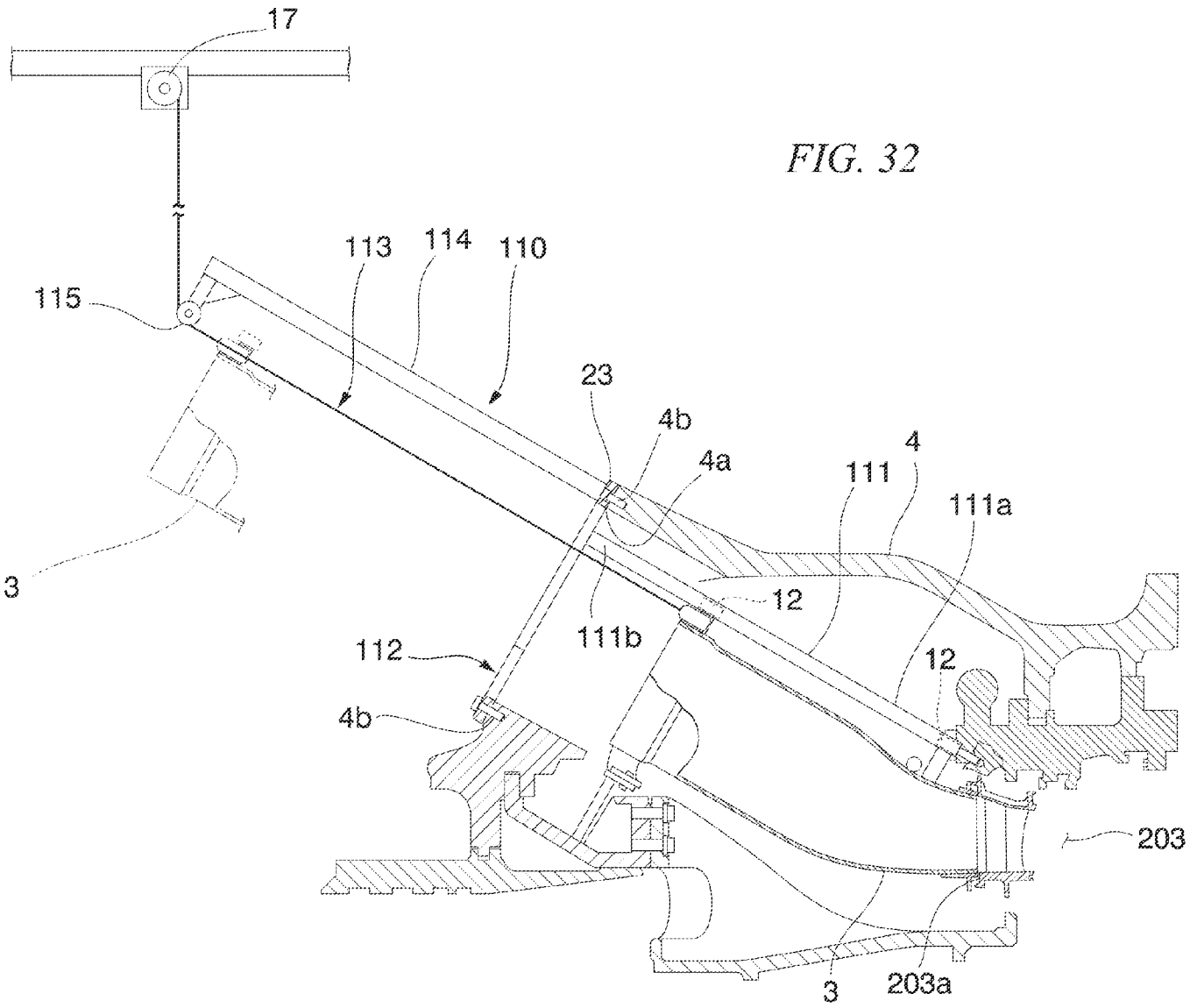
FIG. 32 is a cross-sectional view showing a state where an attaching and detaching fixture of a second embodiment of the invention is attached to the casing.

Next, a second embodiment of the invention will be described. FIG. 32 shows the second embodiment of the invention. Furthermore, in this embodiment, the same reference numerals are given to the same components used in the above-described embodiment, and the description thereof is omitted here.

As shown in FIG. 32, an attaching and detaching fixture 110 does not include the second casing attaching plate 26, the support member 27, the fixing plate 28, and the base end member 21, but a guide portion 111 guiding the tail cylinder 3 so as to be movable along the axis line L of the combustor 1 is only the front end member 20. That is, in the guide portion 111, a front end 111*a* is supported by the inner surface of the casing 4 in a manner such that the support pin 22 provided in the front end 111*a* is fitted to the concave portion 4*c* of the casing 4. Further, the base end 111*b* is supported by the outer surface of the casing 4 by using the first casing attaching plate 23 as the base end fixing portion 112. Further, in the embodiment, a driving mechanism 113 includes a support frame 114 that protrudes from the first casing attaching plate 23, a roller 115 that is rotatably supported by the support frame 114, a wire 116 of which one end is connected to the tail cylinder 3 supported by the guide portion 111 and the other end extends upward while the direction thereof is switched at the roller 115, and a crane 117 that pulls the wire 116. The length of the support frame 114 is set to be sufficiently longer than the entire length of the tail cylinder 3, so that the tail cylinder 3 may be disposed between the opening portion 4*a* of the casing 4 and the roller 115. Even in such a driving mechanism 113, the tail cylinder 3 may be moved along the guide portion 11 by the operation of pulling the wire 116 using the crane 117, so that the tail cylinder 3 may be attached to and detached from the casing 4.

While the embodiments of the invention have been described in detail with reference to the drawings, it should be understood that the detailed structure is not limited to the embodiments and design changes and the like are included in the scope which does not depart from the spirit of the invention.

INDUSTRIAL APPLICABILITY

According to the tail cylinder attaching and detaching fixture and the tail cylinder attaching method of the invention, it is possible to attach and detach the tail cylinder to and from the inside of the casing even in a restricted space with a simple device structure.

DESCRIPTION OF REFERENCE NUMERALS

3: TAIL CYLINDER
4: CASING
4*a*: OPENING PORTION
4*b*: COVER FIXING BOLT HOLE (COVER BODY FIXING PORTION)
4*c*: CONCAVE PORTION
7: COVER BODY
10, 110: ATTACHING AND DETACHING FIXTURE
11, 70, 111: GUIDE PORTION
11*f*: FRONT END
11*g*: BASE END
13, 50, 113: ADVANCING AND RETRACTING MECHANISM
20: FRONT END MEMBER
21: BASE END MEMBER
22: SUPPORT PIN
25, 112: BASE END FIXING PORTION
27: SUPPORT MEMBER
203: COMBUSTION GAS PASSAGEWAY
203*a*: INLET PORTION
L: AXIS LINE

The invention claimed is:

1. A tail cylinder attaching and detaching fixture that attaches and detaches a tail cylinder to and from a casing, the tail cylinder included in a combustor inserted into the casing so that a front end is connected to an inlet portion of a combustion gas passageway, the tail cylinder attaching and detaching fixture comprising:

a guide portion of which the front end is disposed inside the casing and the front end and the base end are respectively supported by the casing and which supports the tail cylinder so as to be movable in an axial direction of the combustor;

an advancing and retracting mechanism configured to advance and retract the tail cylinder in the axial direction; and a support pin in a front end of the guide portion so as to be fitted to a concave portion provided inside the casing, wherein the front end of the guide portion is supported in a manner such that the support pin is fitted to the concave portion.

2. The tail cylinder attaching and detaching fixture according to claim 1, further comprising:

a base end fixing portion that is fixed to an outer surface of the casing, wherein a base end of the guide portion protrudes from an opening portion of the casing toward an outside of the casing and is supported by the base end fixing portion.

3. The tail cylinder attaching and detaching fixture according to claim 2, wherein the guide portion includes a front end member that is disposed inside the casing and a base end member that is attachably and detachably connected to the front end member and is disposed outside the casing.

4. The tail cylinder attaching and detaching fixture according to claim 2, wherein the base end fixing portion comprises:

an attachment member provided along an outer edge of the opening portion and is attached to a cover body fixing portion fixing a cover body blocking the opening portion, and a support member that protrudes from the attachment member and supports the base end of the guide portion.

5. The tail cylinder attaching and detaching fixture according to claim 1, further comprising:

a moving portion that is attachably and detachably provided in the tail cylinder and is guided by the guide portion in the axial direction.

6. The tail cylinder attaching and detaching fixture according to claim 1, wherein the support pin is attached so that the position is adjustable about the axis line of the guide portion.

7. A tail cylinder attaching method of inserting a tail cylinder of a combustor into a casing so that a front end is connected to an inlet portion of a combustion gas passageway, the tail cylinder attaching method comprising:

inserting a guide portion, which moves the tail cylinder in an axial direction of the combustor, from a front end of the guide portion into the casing;

fixing the front end and a base end of the guide portion into the casing in the axial direction of the combustor;

attaching the tail cylinder to the guide portion;

moving the tail cylinder toward the front end along the guide portion;

connecting the tail cylinder to the inlet portion of the combustion gas passageway, and supporting the front end of the guide portion in a manner such that a support pin is fitted to a concave portion, the support pin provided in the front end of the guide portion and designed to fit to the concave portion provided inside the casing.

8. The tail cylinder attaching method according to claim 7, wherein the guide portion includes a front end member disposed inside the casing and a base end member connected to the front end member and disposed outside the casing, and wherein when the guide portion is inserted into the casing, the front end member is inserted into the casing so that the front end and the base end of the front end member are supported by the casing, the front end of the base end member is connected to the base end of the front end member supported by the casing, and then the base end of the base end member is supported by an outer surface of the casing.

9. The tail cylinder attaching method according to claim 8, wherein before the front end of the base end member is connected to the base end of the front end member, the tail cylinder is attached to the base end member, and the front end of the base end member attached with the tail cylinder is connected to the base end of the front end member.

* * * * *